US012402692B2

(12) United States Patent
Campos, II et al.

(10) Patent No.: US 12,402,692 B2
(45) Date of Patent: Sep. 2, 2025

(54) SOLE STRUCTURE WITH MIDSOLE PROTRUSIONS AND ARCED PROFILE FOR FORWARD MOMENTUM

(71) Applicant: NIKE, Inc., Beaverton, OR (US)

(72) Inventors: Fidencio Campos, II, Dallas, OR (US); Karen S. Dimoff, Portland, OR (US); Derek A. Fitchett, Beaverton, OR (US); Emily Harrington, Beaverton, OR (US); Joseph L. Helseth, Plano, TX (US); Oliver McLachlan, Beaverton, OR (US); Colin Runkle, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/307,179

(22) Filed: Apr. 26, 2023

(65) Prior Publication Data

US 2023/0255314 A1 Aug. 17, 2023

Related U.S. Application Data

(63) Continuation of application No. 17/372,733, filed on Jul. 12, 2021, now Pat. No. 11,666,119.

(60) Provisional application No. 63/051,110, filed on Jul. 13, 2020.

(51) Int. Cl.

| | |
|---|---|
| ***A43B 13/22*** | (2006.01) |
| ***A43B 13/14*** | (2006.01) |
| ***A43B 13/18*** | (2006.01) |

(52) U.S. Cl.
CPC ..... *A43B 13/223* (2013.01); *A43B 13/145* (2013.01); *A43B 13/184* (2013.01)

(58) Field of Classification Search
CPC .... A43B 13/223; A43B 13/125; A43B 13/184
See application file for complete search history.

(56) References Cited

U.S. PATENT DOCUMENTS

| | | | | |
|---|---|---|---|---|
| 4,372,059 A * | 2/1983 | Ambrose | ..... | A43B 13/184 36/103 |
| 4,733,483 A * | 3/1988 | Lin | ..... | A43B 1/0072 36/28 |
| 4,908,962 A * | 3/1990 | Yung-Mao | ..... | A43B 13/184 36/28 |

(Continued)

FOREIGN PATENT DOCUMENTS

| | | |
|---|---|---|
| CN | 103402385 A | 11/2013 |
| CN | 103906445 A | 7/2014 |

(Continued)

*Primary Examiner* — Megan E Lynch
(74) *Attorney, Agent, or Firm* — Quinn IP Law

(57) ABSTRACT

A footwear sole structure includes a midsole having a ground-facing surface with a forefoot region, a midfoot region, and a heel region. The midsole defines downwardly-extending protrusions at the ground-facing surface distributed over the midfoot region and the heel region, each of the downwardly-extending protrusions having a convex outer surface. A height of the midsole is greatest at the midfoot region. The sole structure may also include an outsole covering at least a portion of the ground-facing surface of the midsole, and a height of the sole structure may be greatest at the midfoot region.

13 Claims, 29 Drawing Sheets

(56) References Cited

U.S. PATENT DOCUMENTS

| | | | | |
|---|---|---|---|---|
| 5,222,311 | A * | 6/1993 | Lin | A43B 1/0072 36/28 |
| 5,507,106 | A * | 4/1996 | Fox | A43B 13/143 36/114 |
| 9,289,028 | B1 | 3/2016 | Anderson | |
| D833,129 | S * | 11/2018 | Fudalik | D2/954 |
| 2005/0268490 | A1* | 12/2005 | Foxen | A43B 7/1445 36/28 |
| 2006/0130368 | A1* | 6/2006 | Morgan | A43B 13/145 36/59 R |
| 2011/0131832 | A1 | 6/2011 | Brandt et al. | |
| 2013/0247422 | A1* | 9/2013 | Holt | A43B 13/20 36/83 |
| 2016/0192737 | A1* | 7/2016 | Campos, II | B32B 27/40 12/146 B |
| 2016/0255911 | A1* | 9/2016 | Fujita | A43B 13/12 |
| 2017/0135439 | A1* | 5/2017 | Davis | A43B 13/181 |
| 2017/0251753 | A1* | 9/2017 | Meschter | A43B 17/00 |
| 2017/0251754 | A1* | 9/2017 | Meschter | A43B 13/26 |
| 2017/0265564 | A1* | 9/2017 | Peyton | A43B 13/16 |
| 2018/0242685 | A1 | 8/2018 | Jackinsky | |
| 2018/0295936 | A1 | 10/2018 | Hansen et al. | |
| 2018/0338575 | A1* | 11/2018 | Elder | B32B 7/022 |
| 2018/0338578 | A1* | 11/2018 | Elder | B32B 27/08 |
| 2019/0000180 | A1 | 1/2019 | Moriyasu et al. | |
| 2019/0223552 | A1* | 7/2019 | Hollinger | A43B 13/16 |
| 2019/0343224 | A1* | 11/2019 | Dean | A43B 13/184 |
| 2020/0275739 | A1* | 9/2020 | Linkfield | A43B 13/127 |
| 2020/0375308 | A1* | 12/2020 | Langvin | A43B 13/16 |
| 2020/0390189 | A1* | 12/2020 | Campos, II | A43B 13/206 |

FOREIGN PATENT DOCUMENTS

| | | | | |
|---|---|---|---|---|
| KR | 840000343 | B1 | 3/1984 | |
| KR | 100706610 | B1 | 4/2007 | |
| KR | 100927194 | B1 * | 1/2009 | |
| KR | 100930582 | B1 | 12/2009 | |
| WO | WO-9214372 | A1 * | 9/1992 | A43B 13/223 |
| WO | WO-2011051887 | A1 * | 5/2011 | A43B 13/184 |
| WO | WO-2017160730 | A1 * | 9/2017 | A43B 1/0072 |

* cited by examiner

SOLE STRUCTURE WITH MIDSOLE PROTRUSIONS AND ARCED PROFILE FOR FORWARD MOMENTUM

CROSS-REFERENCE TO RELATED APPLICATIONS

This application is a continuation of U.S. Nonprovisional application Ser. No. 17/372,733, filed Jul. 12, 2021, now issued as U.S. Pat. No. 11,666,119, issued Jun. 6, 2023, which claims the benefit of priority to U.S. Provisional Application No. 63/051,110, filed Jul. 13, 2020, and each which is hereby incorporated by reference in its entirety.

TECHNICAL FIELD

The present disclosure generally relates to a sole structure for an article of footwear including a midsole with downwardly-extending protrusions.

BACKGROUND

Footwear typically includes a sole assembly configured to be located under a wearer's foot to space the foot away from the ground. Sole assemblies in athletic footwear are configured to provide desired cushioning, motion control, and resiliency and are often composed of multiple components of different materials in order to meet durability, stability, and cushioning goals. For example, some components may have high energy return and elastic resiliency under compressive loading, while other components may have less elastic resiliency but greater abrasion resistance. Footwear manufacturers strive to design and assemble the various components to enable each to achieve its functionality.

BRIEF DESCRIPTION OF THE DRAWINGS

The drawings described herein are for illustrative purposes only, are schematic in nature, and are intended to be exemplary rather than to limit the scope of the disclosure.

DESCRIPTION

Figure 1:
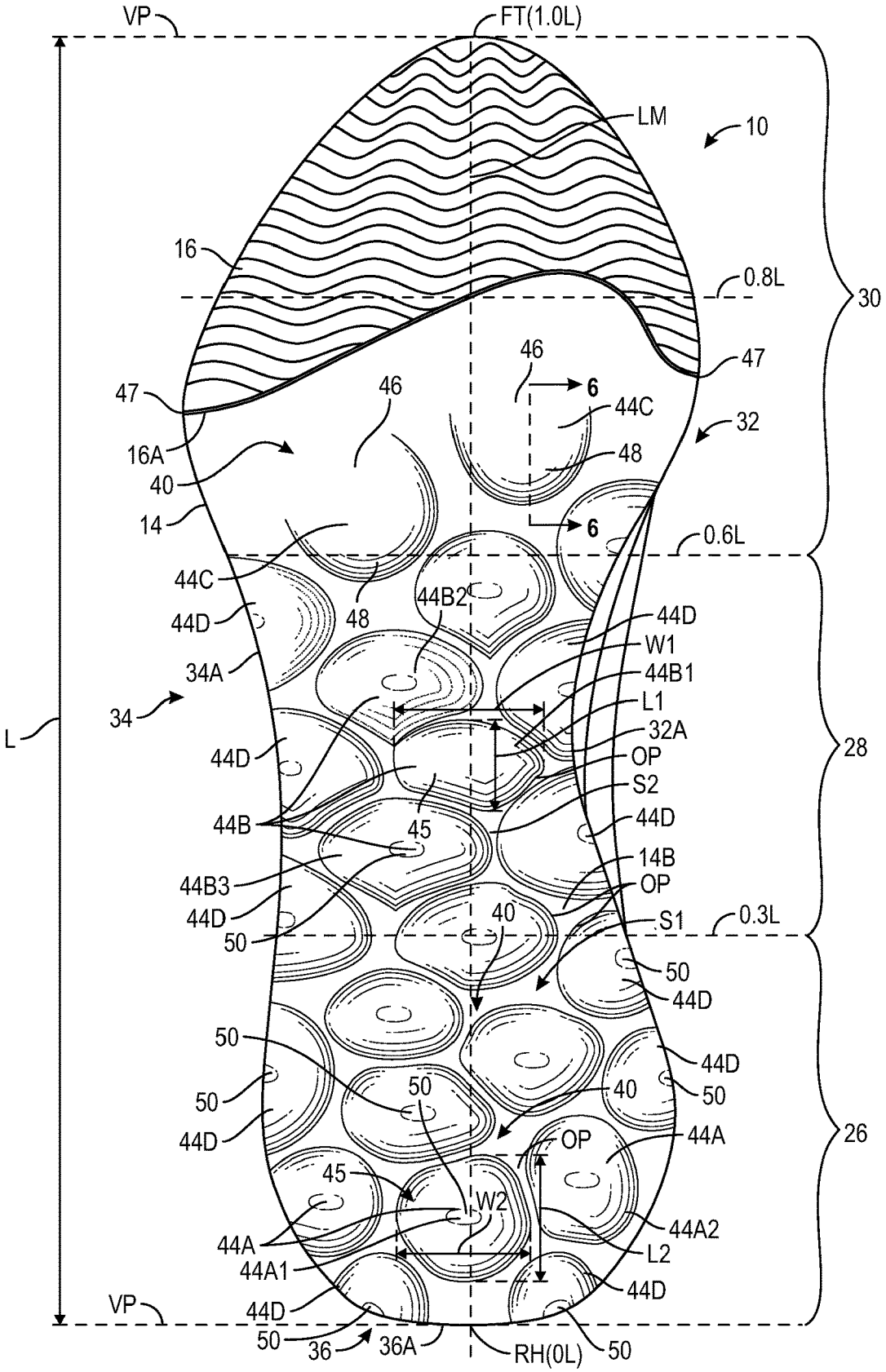
FIG. 1 is a bottom view of a sole structure for an article of footwear including a midsole and an outsole.

The present disclosure generally relates to a sole structure for an article of footwear having features that may be especially advantageous for a variety of forward paces, including walking, relatively slow running, and for leisure wear, and/or a combination of these activities. For example, the sole structure may include a midsole that promotes a soft landing upon impact, and encourages an efficient and relatively even forward momentum through a forward stride from heel impact, through the midfoot region, to toe-off from a supportive and relative stiff platform at the forefoot region. Walkers and slower runners may tend to land on the heel region more frequently than a faster performance runner, so a design that both mitigates heel impact and promotes a smooth, efficient transition from heel to toe is especially beneficial for these activities and paces.

More specifically, a sole structure for an article of footwear may include a midsole having a ground-facing surface with a forefoot region, a midfoot region, and a heel region. The midsole may define downwardly-extending protrusions at the ground-facing surface distributed over the midfoot region and the heel region. Each of the downwardly-extending protrusions may have a convex outer surface. A height of the midsole may be greatest at the midfoot region.

Additionally, a height of the midsole may be greater at the midfoot protrusions than at the heel protrusions, and greater at the midfoot protrusions than at the forefoot region. Such an embodiment enables a "rocker" functionality of the midsole. For example, the ground-facing surface of the midsole may curve upwardly from the midfoot region to a forward extent of the midsole and from the midfoot region to a rear extent of the midsole, establishing an arced profile of the midsole. With such a full-length, convex camber, only a relatively small area of the ground-facing surface is in contact with a horizontal ground plane at any time during a forward stride, and the rate of transitioning forward on the midsole is relatively constant in comparison to sole structures configured so that a large portion of the midfoot region comes into contact with the ground very abruptly upon transition from a heel region to a midfoot region, for example. This helps to avoid a "slapping" phenomena and associated foot fatigue that may occur with such sole structures configured so that a large portion of the midfoot region comes into contact with the ground very abruptly upon transition from a heel region to a midfoot region.

In an implementation, the ground-facing surface of the midsole may curve upwardly from the midfoot region to a forward extent of the midsole and from the midfoot region to a rear extent of the midsole, establishing an arced profile of the midsole.

In contrast to the midfoot region and heel region having the downwardly-extending protrusions, in one or more implementations, the ground-facing surface of the forefoot region may be relatively flat. To provide a stable platform for toe-off from the forefoot region, downwardly-extending protrusions may be absent from at least a forward half of the forefoot region.

The midsole may include a rear side wall that flares outward from an upper extent to a lower extent of the rear side wall at a rear of the heel region. This may help to steer the midsole into the forward rocking motion early in the forward stride. The compressibility of the protrusions mitigates impact to protect against muscle fatigue, while the arced profile promotes an efficient transition from heel strike to toe-off. Typically, it is difficult to achieve both of these goals, as increasing compressibility often decreases the efficiency of forward motion (e.g., the wearer may need to exert more energy to maintain forward momentum in a highly compressible, cushioned midsole without an arced profile than in one with an arced profile).

In an implementation, the midsole may include a lateral side wall and a medial side wall each of which has an upper extent and a lower extent and each of which flares outward from the upper extent to the lower extent in the forefoot region. Accordingly, the forefoot region may be relatively flat and wide. The height of the midsole in the forefoot region should be sufficient to provide adequate cushioning, while the relative flatness of the foam (absence of the downwardly-extending protrusions) makes this region relatively stiff in comparison to other regions to provide support for an efficient toe-off.

Additionally, the downwardly-extending protrusions may include forwardmost protrusions each having a front half and a rear half, and the convex outer surface may be steeper at the rear half than at the front half. The front half, being less steep, may more gradually extend into a relatively flat forefoot region of the ground-facing surface forward of the forwardmost protrusions (e.g., relatively flat in comparison to the midfoot and heel regions).

For stability in the midfoot region given the convex shapes of the downwardly-extending protrusions, the downwardly-extending protrusions may include peripheral protrusions in the midfoot region that define a lateral side edge and a medial side edge of the ground-facing surface. The peripheral protrusions may be truncated at the lateral side edge and at the medial side edge such that peaks of the peripheral protrusions lie along the lateral side edge and the medial side edge. The peripheral protrusions provide widely spaced contact areas with the ground plane, increasing medial-lateral stability. Similar truncated peripheral protrusions may define a rear edge with peaks lying along the rear edge for stability upon heel impact.

The midsole may be a one-piece foam body. For example, each of the downwardly-extending protrusions and the base from which they extend may be a single, unitary, one-piece component. For example, a foam material may be injection molded, compression molded, or otherwise manufactured as a foam body that is a one-piece component. In some examples, the foam material may comprise an EVA foam, such as a blend of EVA material or materials, for example.

In an implementation, the sole structure may include an outsole covering at least a portion of the ground-facing surface of the midsole. A height of the sole structure may be greatest at the midfoot region. Stated differently, the height of the sole structure, including the height of both the midsole and the outsole, may be greatest at the midfoot region. Accordingly, like the midsole, the sole structure (including both the midsole and the outsole) also has an arced profile.

In an implementation, the sole structure may include an outsole that has an outsole element secured to the ground-facing surface of the midsole in the forefoot region. For example, the outsole element may be a first outsole element, and the outsole may further include a second outsole element covering the ground-facing surface of the midsole in the heel region.

In an implementation, the outsole may further include a third outsole element covering the ground-facing surface of the midsole in the midfoot region. The first outsole element and the third outsole element may be separated by a first gap extending from a medial edge to a lateral edge of the midsole. The midsole may include a first ridge that extends into and at least partially fills the first gap. Similarly, the second outsole element and the third outsole element may be separated by a second gap extending from the medial edge to the lateral edge of the midsole. The midsole may include a second ridge that extends into and at least partially fills the second gap between the second outsole element and the third outsole element. In some configurations, the first ridge and the second ridge may be nonlinear.

In implementations such as those in which the outsole includes discrete outsole elements separated from one another, the flexibility of the midsole may be less constrained by the outsole in comparison to an embodiment in which a one-piece outsole extends across most or all of the ground-facing surface.

In an implementation, the outsole may be thicker at peaks of the downwardly-extending protrusions than at the ground-facing surface of the midsole between adjacent peaks of the downwardly-extending protrusions. The outsole may be a relatively durable material in comparison to the material of the midsole, and the thickness at the peaks aids in durability of the sole structure, slowing wear. The material of the midsole may be relatively more compressible than the material of the outsole, and the relative thinness of the outsole between the peaks may therefore enable greater movement and deformation of the downwardly-extending protrusions during compression in comparison to a thicker outsole between the peaks, Stated differently, an outsole with relatively thin areas between the peaks may constrain the midsole less than if the material between the peaks were thicker, allowing greater resilient deformation and related cushioning.

In an implementation, the midsole may include a medial side wall having a lower medial side edge and a lateral side wall having a lower lateral side edge. The outsole may extend to and underlie the medial side edge and the lateral side edge, terminating at the medial side edge and the lateral side edge without extending onto the medial side wall and the lateral side wall. By not extending onto the medial side wall and the lateral side wall, the midsole is less constrained by the outsole and may resiliently deform to a greater degree, providing greater cushioning.

In an implementation, the outsole may include a forefoot outsole element, a midfoot outsole element, and a heel outsole element. Each of the forefoot outsole element, the midfoot outsole element, and the heel outsole element may extend from a medial side wall to a lateral side wall of the midsole. A rear edge of the forefoot outsole element may be spaced apart from a forward edge of the midfoot outsole element defining a first gap between the rear edge of the forefoot outsole element and the forward edge of the midfoot outsole element. A rear edge of the midfoot outsole element may be spaced apart from a forward edge of the heel outsole element defining a second gap between the rear edge of the midfoot outsole element and the forward edge of the heel outsole element. Because the midsole may be more flexible than the outsole, the gaps allow greater movement of the midsole during dorsiflexion, for example, than if the outsole extended without gaps along a ground-facing surface of the midsole from a heel region to a forefoot region of the midsole.

Still further, the rear edge of the forefoot outsole element may have an irregular shape, and the forward edge of the midfoot outsole element may have a complementary irregular shape that tracks the irregular shape of the rear edge of the forefoot outsole element.

Similarly, the forward edge of the heel outsole element may have an irregular shape, and the rear edge of the midfoot outsole element may have a complementary irregular shape that tracks the irregular shape of the forward edge of the heel outsole element.

By providing edges of adjacent outsole elements that are complementary and track one another, the competing goals of covering the ground-facing surface of the midsole with the outsole to increase durability and allowing flexibility and deformation of the midsole without excessive constraint by the outsole may both be achieved.

In an implementation, the midsole may include a first ridge that extends into and at least partially fills the first gap, and the midsole may further include a second ridge that extends into and at least partially fills the second gap. The ridges of the midsole may thus define a portion of the ground-engaging surface.

In one or more implementations, an outsole element may cover the ground-facing surface of the midsole only in the forefoot region. Stated differently, the ground-facing surface of the midsole in the midfoot region and in the heel region may serve as the ground-engaging surface along with the outsole element in the forefoot region. In one such configuration, forwardmost protrusions of the downwardly-extending protrusions are rearward of a widest portion of the midsole in the forefoot region, and a majority of the outsole element is forward of the widest portion of the midsole in the forefoot region. Providing an outsole element in the forefoot region may enable increased durability and traction needed for toe-off. In some embodiments, the material of the midsole alone may provide sufficient durability and traction such that no outsole element is included.

In a configuration, the sole structure may comprise a midsole having a ground-facing surface with a forefoot region, a midfoot region, and a heel region. The midsole may define downwardly-extending protrusions at the ground-facing surface distributed over the midfoot region and the heel region and absent from at least a forward half of the forefoot region. Each of the downwardly-extending protrusions may have a convex outer surface. The downwardly-extending protrusions may include midfoot protrusions in the midfoot region having widths in a transverse direction of the midsole greater than lengths in a longitudinal direction of the midsole. The downwardly-extending protrusions may also include heel protrusions in the heel region having width-to-length ratios less than width-to-length ratios of the midfoot protrusions. For example, the midfoot protrusions may be relatively oblong and the heel protrusions may be relatively round.

To promote resilient deformation in the case of a heel strike and a resulting soft feel upon impact, spacing between adjacent ones of the heel protrusions may be greater than spacing between adjacent ones of the midfoot protrusions. More space between protrusions enables greater "movement" or outward spread of the protrusions under compression without interference from neighboring protrusions (e.g., lower compressive stiffness). The relatively lower width-to-length ratio of the heel protrusions enables greater deformation regardless of an exact impact angle or location in the heel region of initial ground contact in a heel strike.

When the sole structure rolls forward so that the midfoot protrusions come into contact with the horizontal ground plane, the transversely-elongated shape of a midfoot protrusion may cause it to compress down upon its front half, rolling over its peak, providing forward momentum as it straightens upon decompression as compressive force of the foot moves forward to the forefoot region. This may be referred to as longitudinal shear. Additionally, the transversely-elongated shape of the midfoot protrusions make them more resistant to transverse shear under transverse (medial-lateral) loading (e.g., when the sole structure is worn on the "outside" foot during a turn).

In an example configuration, the midsole may be a foam body and the midfoot protrusions may be a ground contact surface of the foam body, such as when the weight of the foot is centered over the midfoot region so that the midfoot protrusions are in contact with the ground. In the same or another configuration, the heel protrusions may be a ground contact surface of the foam body, such as when the weight of the foot is centered over the heel region. Stated differently, the ground-facing surface of the midsole may be the ground-contact surface, the midsole thereby also serving the function of an outsole where the ground-facing surface is also the ground-contact surface. For example, no outsole element(s) may be secured to the ground-facing surface of the midsole at the midfoot protrusions and or at the heel protrusions in such configurations.

In a configuration, a sole structure for an article of footwear may comprise a midsole having a ground-facing surface with a forefoot region, a midfoot region, and a heel region. The midsole may define downwardly-extending protrusions distributed over the midfoot region and the heel region, and the forefoot region may be relatively flat. The downwardly-extending protrusions may have convex outer surfaces and may transition in a forward direction from relatively round to relatively oblong and back to relatively round, each of the relatively oblong downwardly-extending protrusions having a width in a transverse direction of the midsole greater than a length in a longitudinal direction of the midsole. The relatively oblong downwardly-extending protrusions may be taller than the relatively round downwardly-extending protrusions. The midsole may arc upward from the midfoot region to the heel region and upward from the midfoot region to the forefoot region.

The above features and advantages and other features and advantages of the present teachings are readily apparent from the following detailed description of the modes for carrying out the present teachings when taken in connection with the accompanying drawings.

Figure 7:
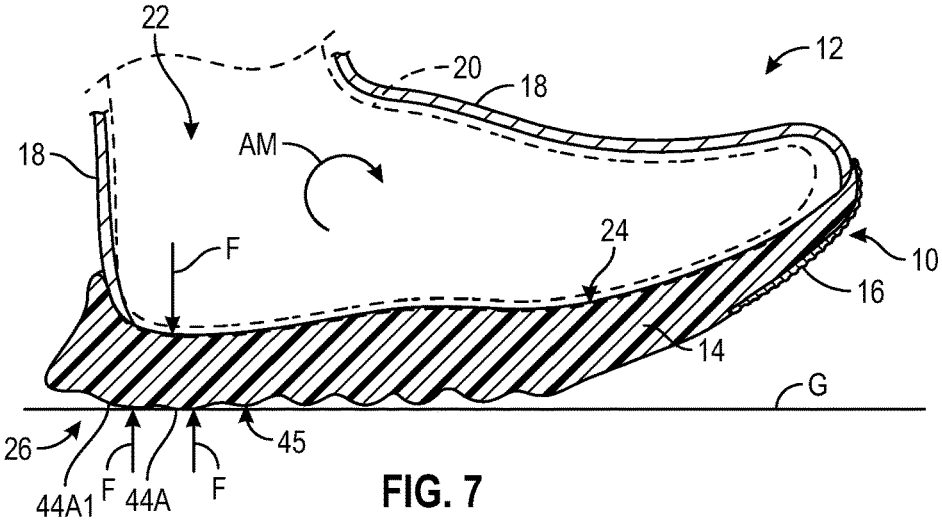
FIG. 7 is a schematic illustration of the sole structure in cross-sectional view worn on a foot shown in phantom during ground contact of a heel region such as during a heel strike of a forward stride.
Figure 8:
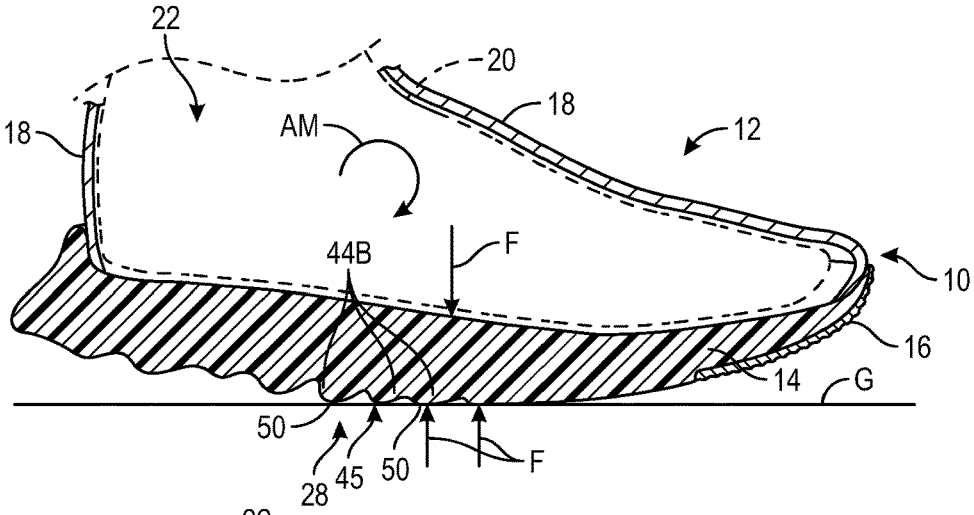
FIG. 8 is a schematic illustration of the sole structure of FIG. 7 during ground contact of a midfoot region during the forward stride.
Figure 9:
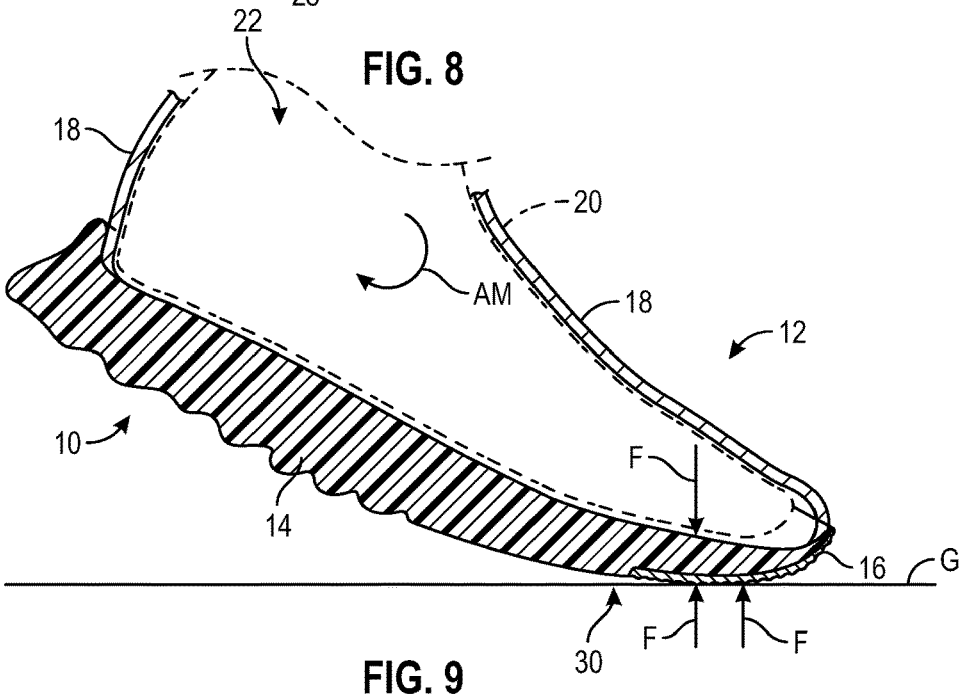
FIG. 9 is a schematic illustration of the sole structure of FIG. 7 during ground contact of a forefoot region during a forward stride.

Referring to the drawings, wherein like reference numbers refer to like components throughout the views, FIG. 1 shows a sole structure 10 for an article of footwear, such as the article of footwear 12 of FIGS. 7-9. FIG. 1 is a bottom view of the sole structure 10. The sole structure 10 includes a midsole 14 and an outsole 16, which, in the embodiment shown, is a single outsole element 16 secured to the midsole 14. The sole structure 10 may include additional components, such as one or more sole layers overlaying the midsole 14 (shown in FIG. 7) and/or one or more bladders that retain gas. For example, a heel bladder may rest on the foot-facing surface 24 of the midsole 14, or nest within the midsole 14 at a heel region 26 of the midsole 14. FIG. 7 shows an upper 18 coupled to the sole structure 10, and a foot 20 shown in phantom received in a foot-receiving cavity 22 defined by the upper 18 and the sole structure 10 and resting on a foot-facing surface 24 of the sole structure 10. A strobel and/or an insole (not shown) may overlay the midsole and be disposed between the foot 20 and the midsole 14. For purposes of discussion herein, however, the foot-facing surface 24 is a top surface of the midsole 14, and the foot 20 is shown on the foot-facing surface 24 of the midsole 14. The foot-facing surface 24 is shown as generally cupping the shape of the bottom of the foot 20. Additionally or in the alternative, the foam of the midsole 14 could be shaped to provide additional geometry at the foot-facing surface 24.

As shown in FIG. 1, the sole structure 10 includes a heel region 26, a midfoot region 28, and a forefoot region 30. The heel region 26 generally includes portions of the sole structure 10 corresponding with rear portions of a human foot, including the calcaneus bone, when the human foot of a size corresponding with the sole structure 10 is supported on the sole structure 10 as shown in FIG. 7. The forefoot region 30 of the sole structure 10 generally includes portions of the sole structure 10 corresponding with the toes and the joints connecting the metatarsals with the phalanges of the human foot (interchangeably referred to herein as the "metatarsal-phalangeal joints" or "MPJ" joints). The midfoot region 28 of the sole structure 10 is disposed between the heel region 26 and the forefoot region 30 and generally includes portions of the sole structure 10 corresponding with an arch area of the human foot, including the navicular joint.

Also, various example features and aspects of the footwear 12 may be disclosed or explained herein with reference to a "longitudinal direction" and/or with respect to a "longitudinal length" of the footwear sole structure 10. As shown in FIG. 1, the "longitudinal direction" is determined as the direction of a line LM extending from a rearmost heel location (RH in FIG. 1) to the forwardmost toe location (FT in FIG. 1) of the sole structure 10. This line LM may also be referred to as the longitudinal midline. The "longitudinal length" L is the length dimension measured from the rearmost heel location RH to the forwardmost toe location FT. The rearmost heel location RH and the forwardmost toe location FT may be located by determining the rear heel and forward toe tangent points with respect to front and back parallel vertical planes VP when the sole structure 10 is oriented on a horizontal support surface such as a ground plane G shown in FIG. 7 in an unloaded condition (e.g., with no weight applied to the sole structure 10 other than the weight of the shoe components of the article of footwear 12, such as the upper 18). If the forwardmost and/or rearmost locations of a specific sole structure constitute a line segment (rather than a tangent point), then the forwardmost toe location and/or the rearmost heel location constitute the midpoint of the corresponding line segment. If the forwardmost and/or rearmost locations of a specific sole structure constitute two or more separated points or line segments, then the forwardmost toe location and/or the rearmost heel location constitute the midpoint of a line segment connecting the furthest spaced and separated points and/or furthest spaced and separated end points of the line segments (irrespective of whether the midpoint itself lies on the sole structure 10). If the forwardmost and/or rearwardmost locations constitute one or more areas, then the forwardmost toe location and/or the rearwardmost heel location constitute the geographic center of the area or combined areas (irrespective of whether the geographic center itself lies on the sole structure 10).

Once the longitudinal direction of the sole structure 10 has been determined with the sole structure 10 oriented on the horizontal ground plane G, planes may be oriented perpendicular to this longitudinal direction (e.g., planes running into and out of the page of FIG. 1). The locations of these perpendicular planes may be specified based on their positions along the longitudinal length L where the perpendicular plane intersects the longitudinal direction between the rearmost heel location RH and the forwardmost toe location FT. In this illustrated example of FIG. 1, the rearmost heel location RH is considered as the origin for measurements (or the "0 L position") and the forwardmost toe location FT is considered the end of the longitudinal length of this component (or the "1.0 L position"). Plane position may be specified based on the plane's location along the longitudinal length L (between 0 L and 1.0 L), measured forward from the rearmost heel RH location in this example. FIG. 1 further shows locations of various planes perpendicular to the longitudinal direction (and oriented in the transverse direction) and located along the longitudinal length L at positions 0.3 L and 0.6 L (measured in a forward direction from the rearmost heel location RH). These planes may extend into and out of the page of the paper from the view shown in FIG. 1, and similar perpendicular planes may be oriented at any other desired positions along the longitudinal length L. While these planes may be parallel to the parallel vertical planes VP used to determine the rearmost heel RH and forwardmost toe FT locations, this is not a requirement. Rather, the orientations of the perpendicular planes along the longitudinal length L will depend on the orientation of the longitudinal direction, which may or may not be parallel to the horizontal ground plane G in the arrangement/orientation shown in FIG. 1.

As shown in FIG. 1, the heel region 26 of the sole structure 10 is defined herein as being between perpendicular planes located at 0 L and 0.3 L of the sole structure 10, the midfoot region 28 of the sole structure 10 is defined herein as being between perpendicular planes located at 0.3 L and 0.6 L, and the forefoot region 30 of the sole structure 10 is defined herein as being between perpendicular planes located at 0.6 L and 1.0 L.

The sole structure 10 has a medial side 32 (also shown in FIG. 4) and a lateral side 34 (also shown in FIG. 3) both of which extend from the heel region 26 to the forefoot region 30 and are generally on opposite sides of the longitudinal midline LM of the sole structure 10. The medial side 32, the lateral side 34, and a rear 36 of the sole structure 10 described herein correspond with and may also be used to indicate the medial side, the lateral side, and the rear of individual components of the sole structure 10, such as of the midsole 14.

Figure 2:
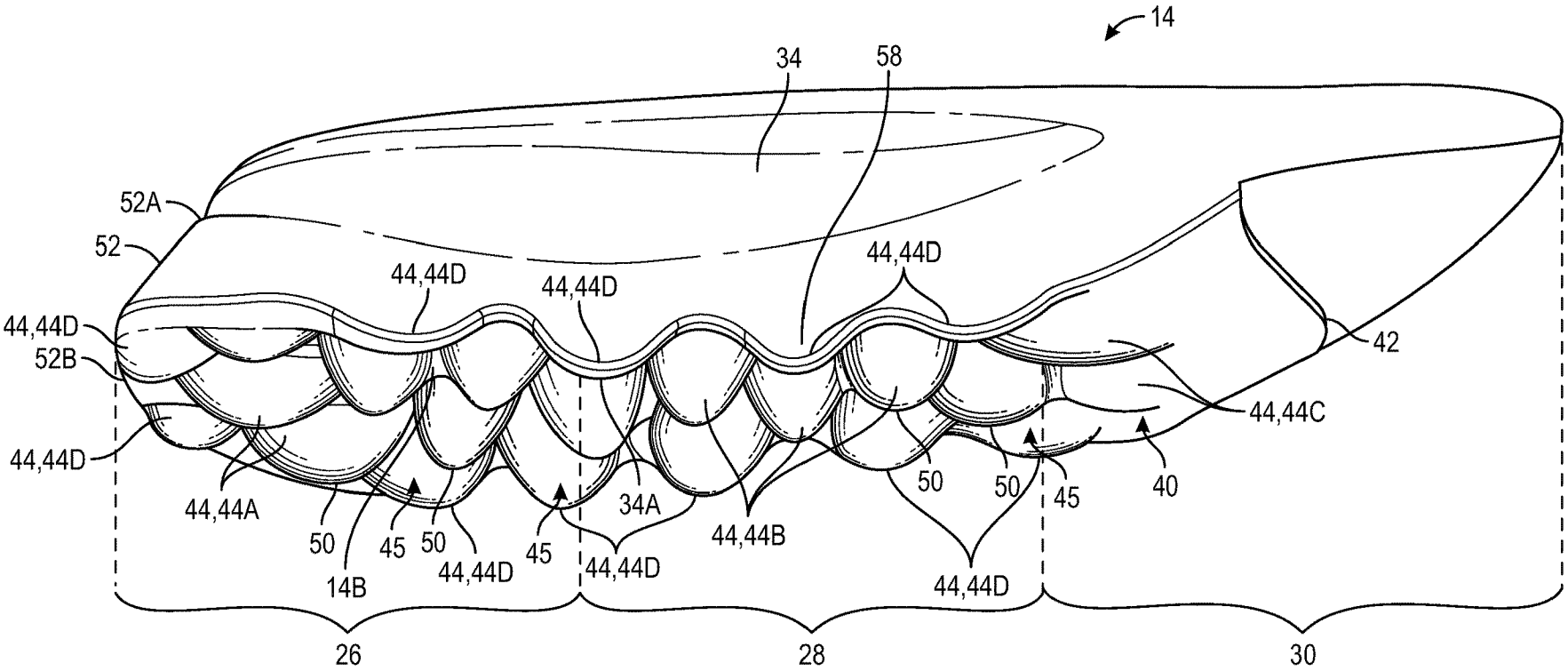
FIG. 2 is a perspective bottom and lateral side view of the midsole without the outsole.

The midsole 14 has a ground-facing surface 40, portions of which fall within the forefoot region 30, the midfoot region 28, and the heel region 26, as shown in FIGS. 1 and 2. In FIG. 2, the outsole element 16 is removed. The midsole 14 has a slight lip 42 disposed in the ground-facing surface 40 on the forefoot region 30. When the outsole element 16 is secured to the ground-facing surface 40 in the forefoot region 30, such as with adhesive and/or thermal bonding, a rear extent of the outsole element 16 abuts the lip 42. The forefoot region 30 has a forward half (e.g., from the vertical plane 0.8 L to the vertical plane VP at the forwardmost toe location FT) and a rear half (e.g., from the vertical plane at 0.6 L to the vertical plane at 0.8 L). In the embodiment shown, the outsole element 16 covers much of the ground-facing surface 40 in the forward half of the forefoot region 30 and a majority of the rear half is uncovered. In other configurations an outsole element may cover more or less of the forefoot region 30 and/or more than one outsole element may be secured to the ground-facing surface 40.

The midsole 14 defines downwardly-extending protrusions 44 at the ground-facing surface 40 distributed over the midfoot region 28 and the heel region 26 and absent from at least the forward half (e.g., from a vertical plane at 0.8 L to the vertical plane VP at the forwardmost toe location FT (at 1.0 L)) of the ground-facing surface 40 of the forefoot region 30. For example, the outsole element 16 covers the ground-facing surface 40 of the midsole 14 only in a portion of the forefoot region 30, and forwardmost protrusions 44C of the downwardly-extending protrusions 44 are rearward of a widest portion 47 of the midsole 14 in the forefoot region 30. A majority of the outsole element 16 is forward of the widest portion 47 of the midsole 14 in the forefoot region 30. Providing the outsole element 16 in the forefoot region 30 may enable increased durability and traction needed for toe-off (shown in FIG. 9). In some embodiments, the material of the midsole 14 alone may provide sufficient durability and traction not only in the midfoot region 28 and heel region 26, but also in the forefoot region 30 such that no outsole element is included in the sole structure 10.

Each of the downwardly-extending protrusions 44 has a convex outer surface 45 as best shown in FIG. 2. Only some of the convex outer surfaces 45 are labelled in FIG. 2 for clarity in the drawings. The downwardly-extending protrusions 44 include midfoot protrusions 44B in the midfoot region 28 having widths in a transverse direction of the midsole 14 greater than lengths in a longitudinal direction of the midsole 14.

The downwardly-extending protrusions 44 also include heel protrusions 44A in the heel region 26 having width-to-length ratios less than width-to-length ratios of the midfoot protrusions 44B. For example, the midfoot protrusions 44B may be relatively oblong and the heel protrusions 44A may be relatively round. In determining a width of a protrusion 44, a measurement is taken perpendicular to the longitudinal midline LM and measuring between the points spaced furthest apart from one another in the transverse direction and falling on an outer perimeter OP of the protrusion 44 (e.g., where an outer perimeter OP falls along an outline of a change in curvature where the protrusion 44 begins extending downward from an overlaying base portion 14B of the midsole 14). Some of the outer perimeters OP are labelled in FIG. 1, and each appears as a closed curve surrounding a protrusion 44. The base portion 14B can be seen as the spaces between the protrusions 44 at the ground-facing surface 40 in FIG. 1. In determining a length of a protrusion 44, a measurement is taken parallel to the longitudinal midline LM and measuring between the points spaced furthest from one another in the longitudinal direction and falling on the outer perimeter OP of the protrusion 44 at the ground-facing surface 40. In referencing a protrusion 44 as being generally oblong or generally round, the reference is with respect to the shape of the outer perimeter OP of the protrusion.

It is noted that not all of the downwardly-extending protrusions 44 in the midfoot region 28 need have widths greater than lengths and/or need be generally oblong in the transverse direction in order to fall within the scope of the disclosure and fulfill the advantages of the sole structure 10 as discussed herein. Additionally, not all of the downwardly-extending protrusions 44A in the heel region 26 need have width-to-length ratios less than the width-to-length ratios of the midfoot protrusions 44B in order to fall within the scope of the disclosure and fulfill the advantages of the sole structure 10 as discussed herein. However, as can be seen in FIG. 1, more of the downwardly-extending protrusions 44A in the heel region 26 are generally round and have width-to-length ratios less than the width-to-length ratios of the midfoot protrusions 44B, more of which are generally oblong.

One example generally oblong midfoot protrusion 44B1 is indicated having a width W1 and a length L1 in FIG. 1. One example generally round heel protrusion 44A1 is indicated having a width W2 and a length L2 in FIG. 1. It can be seen that the ratio of the width W2 to the length L2 of the heel protrusion 44A1 is less than the ratio of the width W1 to the length L1 of the midfoot protrusion 44B1. The heel protrusions 44A include but are not limited to those protrusions that are the rearmost protrusions 44A1 and 44A2 not truncated at an edge of the midsole 14 as discussed herein. The midfoot protrusions 44B include but are not limited to those protrusions 44B1, 44B2, and 44B3 not truncated at an edge of the midsole 14. Additionally, the downwardly-extending protrusions 44 include forwardmost protrusions 44C that may fall within the rear half of the forefoot region 30 and/or may be at a forward portion of the midfoot region 28. Especially viewing the protrusions 44 from the rearmost protrusions not truncated at an edge of the midsole 14 (e.g., protrusions 44A1 and 44A2) to the forwardmost protrusions 44C not truncated at an edge of the midsole 14, the downwardly-extending protrusions 44 that fall along the longitudinal midline LM generally transition in a forward direction from relatively round to relatively oblong and back to relatively round while increasing in height and then decreasing in height. Shorter protrusions are more neutral in terms of the exact location in the heel region 26 that is the first point of contact to lessen the potential of side-to-side movement and an off-balance feeling upon heel strike.

The midsole 14 may be a foam body such as a foamed polymeric material. In some embodiments, the midsole 14 may be at least partially a polyurethane (PU) foam, a polyurethane ethylene-vinyl acetate (EVA) foam, and may include heat-expanded and molded EVA foam pellets. In some examples, the foam material may comprise a blend of EVA material or materials, for example. The midsole 14 may comprise Pebax® thermoplastic elastomer foam and may be sold under the tradename ZoomX by Nike, Inc. The outsole element 16 may include a rubber material than may be a natural rubber, or a synthetic rubber, or a combination of both. Examples of types of rubbers include butadiene rubber, styrene-butadiene (SBR) rubber, butyl rubber, isoprene rubber, urethane rubber, nitrile rubber, neoprene rubber, ethylene propylene diene monomer (EPDM) rubber, ethylene-propylene rubber, urethane rubber, polynorbornene rubber, methyl methacrylate butadiene styrene (MBS) rubber, styrene ethylene butylene (SEBS) rubber, silicone rubber, and mixtures thereof. The rubber compound may be a virgin material, a regrind material, and mixtures thereof.

As the outsole element 16 is disposed only in the forefoot region 30 in the embodiment shown, the convex outer surfaces 45 of the midfoot protrusions 44B, the heel protrusions 44A, and the forwardmost protrusions 44C serve as a ground contact surface of the sole structure 10. For example, some or all of the convex outer surfaces 45 of the heel protrusions 44A as well as the truncated peripheral protrusions 44D in the heel region 26 are a ground contact surface of the sole structure 10, such as during a heel strike and/or when the weight of the foot 20 is centered over the heel region 26 and the heel protrusions 44A are in contact with the horizontal ground plane G, as shown in FIG. 7. Similarly, some or all of the convex outer surfaces 45 of the midfoot protrusions 44B and the truncated peripheral protrusions 44D in the midfoot region 28 are the ground contact surface of the sole structure 10, such as when the weight of the foot 20 is centered over the midfoot region 28 so that the midfoot protrusions 44B are in contact with the ground plane G as shown in FIG. 8. Stated differently, the midsole 14 also serves the function of an outsole in at least the heel region 26 and the midfoot region 28 as the convex outer surfaces 45 of the midfoot protrusions 44B and the heel protrusions 44A as well as the truncated peripheral protrusions 44D are exposed (e.g., uncovered), with no outsole elements secured thereto in the embodiment shown. Alternatively, in some configurations, one or more outsole elements may be secured to the ground-facing surface 40 and/or to the convex outer surfaces 45 of some or all of the downwardly-extending protrusions 44 in the midfoot region 28 and/or the heel region 26.

The midsole 14 is shown as a one-piece foam body. For example, each of the downwardly-extending protrusions 44 and the base portion 14B from which they extend are a unitary, one-piece (e.g., single) component. For example, a foam material may be injection molded, compression molded, or otherwise manufactured as the midsole 14 that is as a one-piece component. In an alternative embodiment, the midsole 14 with the shape shown and described herein including the protrusions of the shapes and sizes shown and described herein could be a fluid-filled bladder that defines an interior cavity and is configured to retain a fluid in the interior cavity. For example, polymeric sheets may be secured to one another at a peripheral flange to enclose the interior cavity and retain a fluid in the interior cavity, or a single polymeric sheet may be folded on itself to define a sealed peripheral flange, or polymeric material in a preform that is not a sheet may be blow-molded to define the bladder. As used herein, a "fluid" filling the interior cavity may be a gas, such as air, nitrogen, another gas, or a combination thereof. The polymeric material when formed and inflated may define the protrusions 44.

Figure 6:
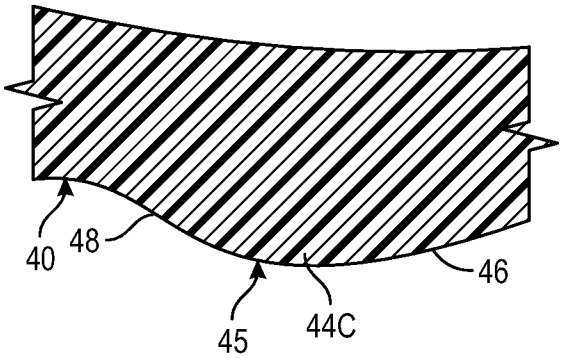
FIG. 6 is a cross-sectional view of the sole structure taken at lines 6-6 in FIG. 1.

As indicated in FIG. 1 and best shown in the closeup view of FIG. 6, the forwardmost protrusions 44C each have a front half 46 and a rear half 48, and the convex outer surface 45 (e.g., the portion of the ground-facing surface 40 at the protrusion 44C) is steeper at the rear half 48 than at the front half 46. The front half 46, being less steep, more gradually extends forward in the forefoot region 30 of the ground-facing surface. The ground-facing surface 40 in the forefoot region 30 has an absence of the downwardly-extending protrusions forward of the forwardmost protrusions 44C, and is relatively flat in comparison to the ground-facing surface 40 in the midfoot region 28 and the heel region 26.

As best shown in FIG. 2, the downwardly-extending protrusions 44 taper in width and length from the base portion 14B to peaks 50. Only some of the peaks 50 are labelled in FIGS. 1 and 2. When a protrusion 44 contacts the horizontal ground plane G, the peak 50 comes into contact with the horizontal ground plane G first, and the protrusion 44 is compressed so that more surface area of the protrusion (e.g., more of the convex outer surface 45) comes into contact with the horizontal ground plane G as loading progresses. Pressure is concentrated at the peak 50 by the initial load due to the relatively small surface area at the peak 50, and lessens as the surface area broadens with compression of the protrusion 44. The distribution of the load over the increasing surface area and the resultant reduction in pressure causes the rate of deflection of the protrusion 44 to decrease with time. Stated differently, due to the shape of the protrusion 44 broadening from the relatively narrow peak 50, the protrusion 44 initially compresses more rapidly and gradually the rate of deflection decreases. This contrasts with a relatively low rate of deflection that would be experienced with a sole structure having a flatter area initially coming into contact with the horizontal ground plane G.

Figure 3:
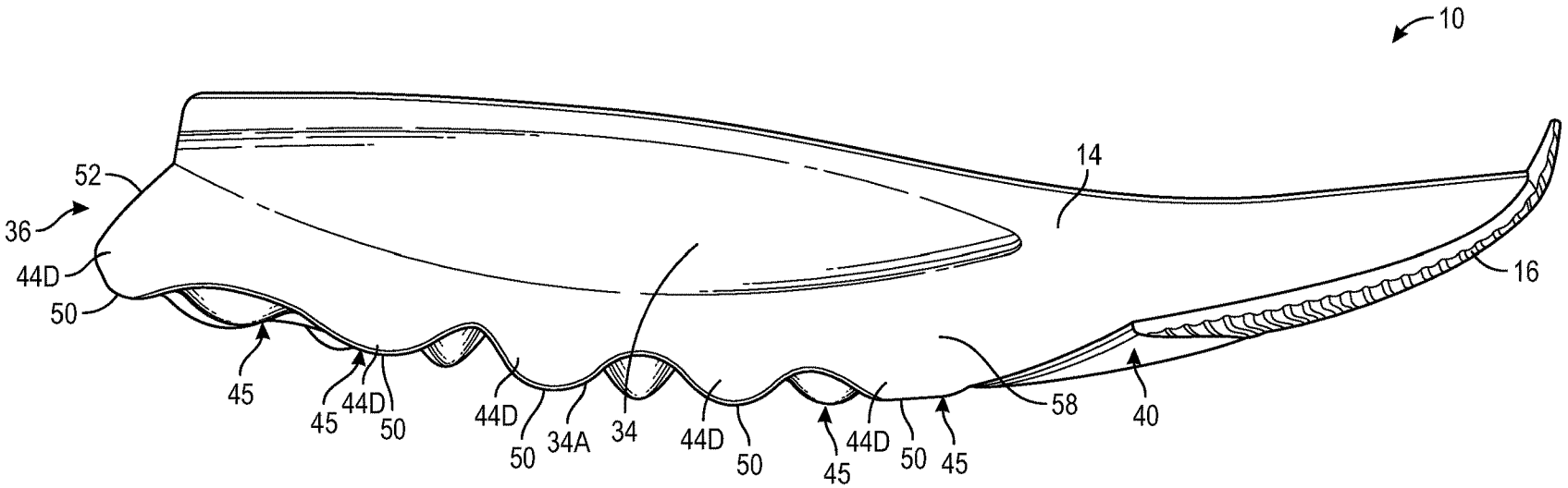
FIG. 3 is a lateral side view of the sole structure.
Figure 4:
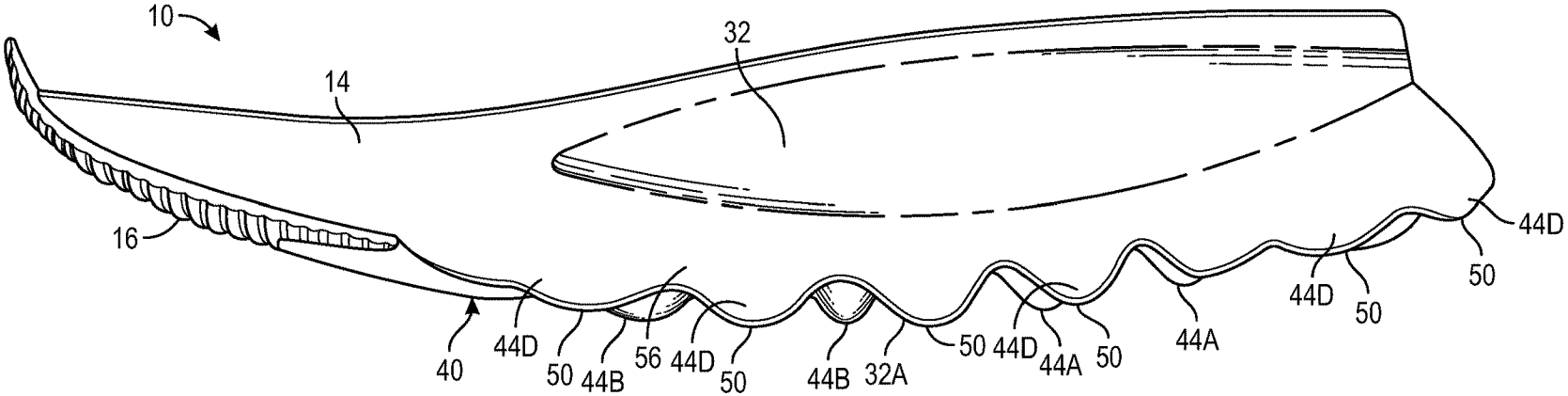
FIG. 4 is a medial side view of the sole structure.
Figure 5:
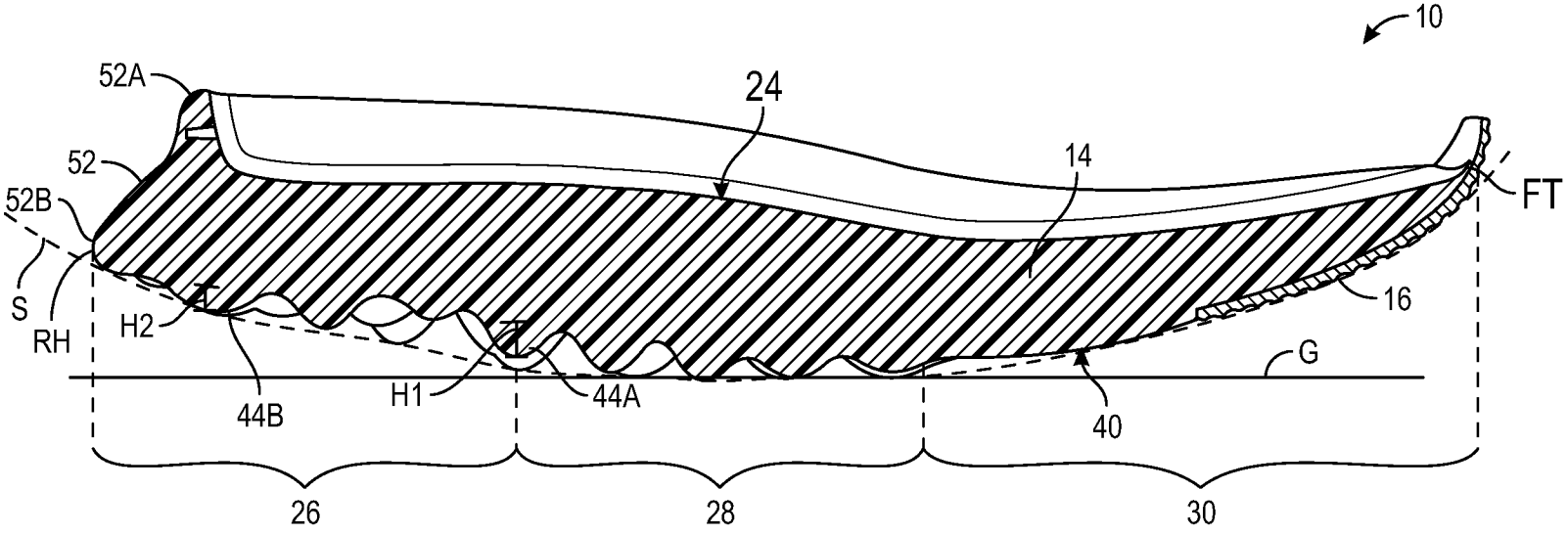
FIG. 5 is a cross-sectional view of the sole structure taken at lines 5-5 in FIG. 15.

As shown in FIGS. 2-6, the relatively oblong downwardly-extending protrusions 44B of the midfoot region 28 are taller than the relatively round downwardly-extending protrusions 44A of the heel region 26. That is, as best shown in FIG. 5, the height H1 of the midfoot protrusion 44B from a plane extending through its outer perimeter OP (outer perimeters indicated in FIG. 1) is greater than the height H2 of the heel protrusion 44A from a plane extending through its outer perimeter OP. The taller midfoot protrusions 44B are able to "lean" during a forward stride, as discussed with respect to FIG. 8.

As shown in FIGS. 3-5, the midsole 14 arcs upward from the midfoot region 28 to the heel region 26, and upward from the midfoot region 28 to the forefoot region 30. Referring to FIG. 5, a surface S tangent to the peaks 50 of the protrusions 44 and tangent to the lower surface of the outsole element 16 remains generally level at any given transverse cross section perpendicular to the longitudinal midline LM, and arcs from the rearmost extent of the midsole 14 (e.g., at the rearmost heel location RH) to a forward extent of the midsole 14 (near the forwardmost toe location FT), establishing an arced profile of the midsole with the midfoot region 28 being lower than the heel region 26 and forefoot region 30 and therefore in contact with the ground plane G when the sole structure 10 is unloaded. As discussed with respect to FIGS. 7-9, this configuration helps to maintain a more constant forward angular momentum (indicated by arrows AM) during a forward stride than a sole structure without such an arced curvature. Such an embodiment enables a "rocker" functionality of the midsole 14. With such a full-length, convex camber, only a relatively small area of the ground-facing surface 40 is in contact with the ground plane G at any time during the stride. This helps to avoid a "slapping" phenomena and associated foot fatigue that may occur with sole structures configured so that a large area of the midfoot region comes into contact with the ground plane abruptly upon transition from the heel region to the midfoot region, for example.

Figure 14:
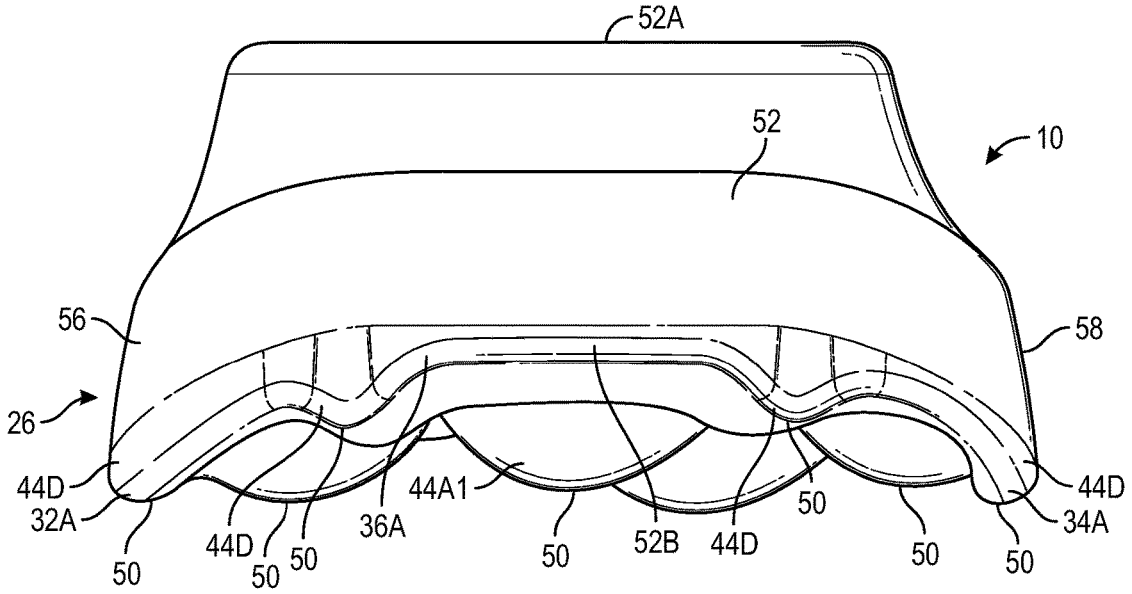
FIG. 14 is a rear view of the sole structure.

FIGS. 2, 3 and 14 also best show that the midsole 14 includes a rear side wall 52 that flares outward from an upper extent 52A to a lower extent 52B of the rear side wall 52 at the rear 36 of the heel region 26. This flare extends the lower extent 52B more rearward than if the rear side wall 52 were more perpendicular to the horizontal ground plane G. This may help to steer the midsole 14 into the forward rocking motion early in a heel strike of a forward stride.

Figure 15:
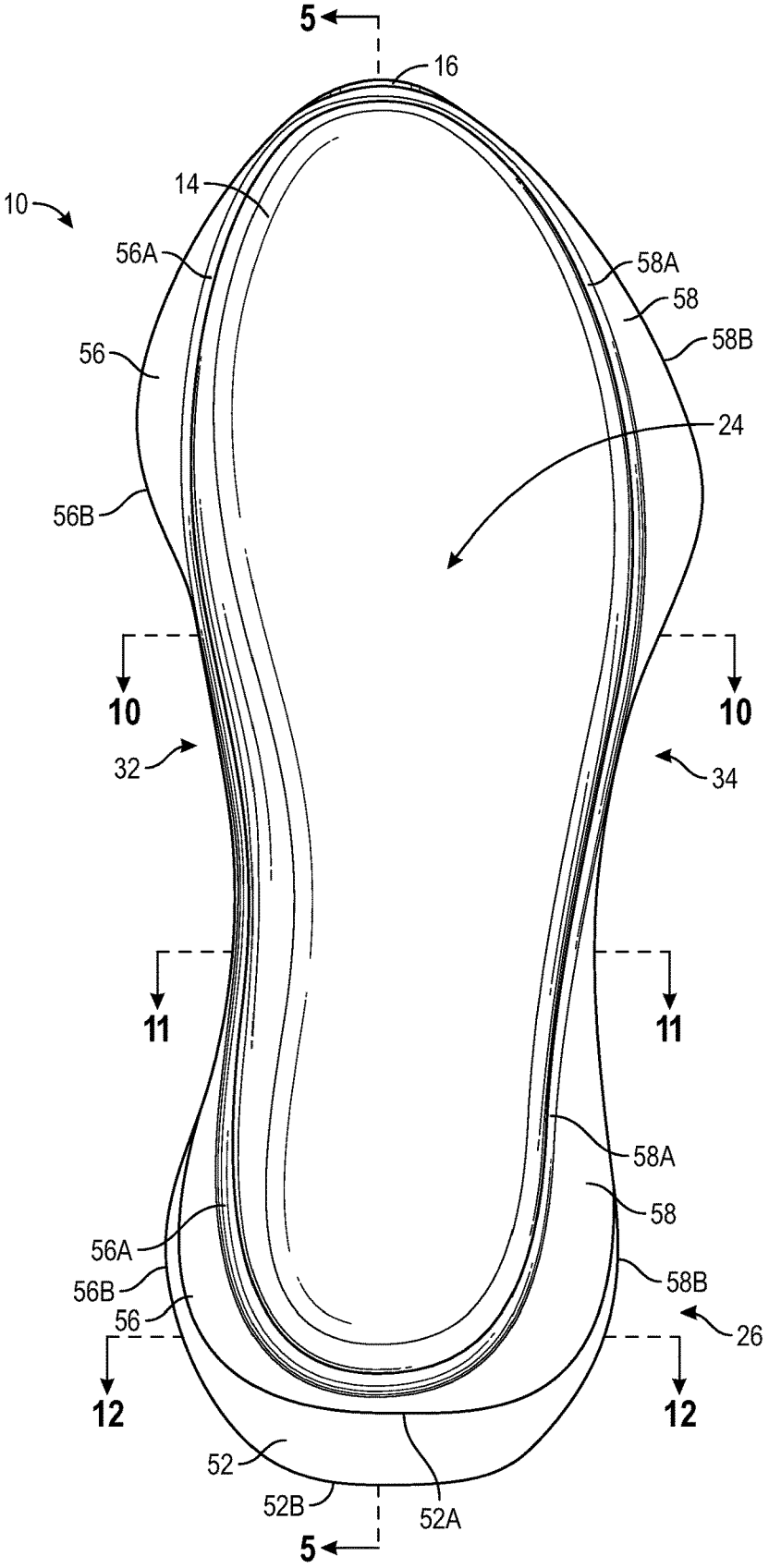
FIG. 15 is a top view of the sole structure.

Similarly, as best shown in FIGS. 12-15, the midsole 14 includes a lateral side wall 58 and a medial side wall 56, each of which has an upper extent and a lower extent and each of which flares outward from the upper extent to the lower extent in both the forefoot region 30 (see FIGS. 13 and 15) and the heel region 26 (see FIGS. 14 and 15). Specifically, as shown in FIG. 15, the medial side wall 56 flares outward from an upper extent 56A to a lower extent 56B. The lateral side wall 58 flares outward from an upper extent 58A to a lower extent 58B. As is evident in FIGS. 1 and 15, the midsole 14 is widest in the forefoot region 30 generally just forward of the forwardmost protrusions 44C and approximately where the rear edge 16A of the outsole element 16 is secured to the midsole 14. The heel region 26 is also relatively wide generally just forward of the rearmost (non-truncated) heel protrusion 44A1 labelled in FIG. 1. The relatively wide and flat forefoot region 30 provides a stable platform for toe-off. The height of the midsole 14 in the forefoot region 30 is sufficient to provide adequate cushioning, while the relative flatness of the midsole 14 in the forefoot region 30 (e.g., relative to the midfoot region 28 and the heel region 26 due to the shorter downwardly-extending protrusions 44 and the absence of downwardly-extending protrusions in the forward portion of the forefoot region 30) makes this region relatively stiff in comparison to the other regions 28, 30 to provide support for an efficient toe-off.

As shown in FIGS. 1-4, the downwardly-extending protrusions 44 include truncated peripheral protrusions 44D in the midfoot region 28 and the heel region 26 that define a lateral side edge 34A and a medial side edge 32A of the ground-facing surface 40 of the midsole 14. Similar truncated peripheral protrusions 44D define a rear edge 36A. The peripheral protrusions 44D are truncated in that they each have only about half of a convex outer surface 45 in comparison to the midfoot protrusions 44B and heel protrusions 44A, as peaks 50 of the truncated peripheral protrusions 44D lie along the lateral side edge 34A, the medial side edge 32A, and the rear edge 36A. Providing peaks 50 along the edges 32A and 34A broadens the width between the two furthest peaks 50 in contact with the ground plane G during the forward stride, increasing medial-lateral stability. Providing peaks 50 along the rear edge 36A and edges 32A, 34A helps to limit the extent of medial-lateral tilt that could occur regardless of whether initial impact is on a non-truncated, fully convex protrusion 44A or 44B.

To promote resilient deformation in the case of a heel strike and resulting soft feel upon impact, spacing between adjacent ones of the heel protrusions 44A may be greater than spacing between adjacent ones of the midfoot protrusions 44B. For example, FIG. 1 shows, on average, more of the ground-facing surface 40 disposed between outer peripheries OP of the heel protrusions 44A (e.g., spacing S1) than the midfoot protrusions 44B (e.g., spacing S2). More space between heel protrusions 44A enables greater "movement" or outward spread of the heel protrusions 44A under compression by compressive forces F without interference from neighboring protrusions (e.g., lower compressive stiffness). The lower width-to-length ratio of the heel protrusions 44A enables greater deformation regardless of an exact impact angle or location in the heel region 26 of initial ground contact in a heel strike, shown in FIG. 7.

FIGS. 7-9 show three instants in time during three different phases of the forward roll of the sole structure 10, with the curved arrows AM indicating the angular momentum of the sole structure 10. As shown in FIG. 7, due to the arced profile of the sole structure 10 discussed herein, only the heel region 26 is in contact with the ground plane G during the initial heel strike.

As forward movement progresses, the sole structure 10 rolls forward so that the midfoot protrusions 44B are in contact with the horizontal ground plane G, Because of the arced profile of the sole structure 10, the heel region 26 and the forefoot region 30 are not in contact with the ground plane G. The relatively tall height of the transversely-elongated midfoot protrusions 44B may cause them to compress down upon their front sides, rolling over their peaks 50 as illustrated in FIG. 8 (e.g., leaning or bending over onto their front sides), each providing forward momentum as it straightens upon decompression as compressive force F of the foot 20 moves forward to the forefoot region 30. The leaning or bending movement may be referred to as longitudinal shear. The relatively tall height of the midfoot protrusions 44B encourages and enables this shearing in the longitudinal direction. However, the transversely-elongated shape of the midfoot protrusions 44B make them more resistant to transverse shear under transverse loading which may occur when turning directions while loading the sole structure 10 (e.g., when the sole structure 10 is worn on the "outside" foot 20 during a turn).

FIG. 9 depicts the sole structure 10 during a further forward roll as the ground-facing surface 40 of the forefoot region 30 becomes the ground contact surface during the forward stride. Because of the arced profile of the sole structure 10, the heel region 26 and the midfoot region 28 are no longer in contact with the ground G. The absence of downwardly-extending protrusions 44 in at least the forward half of the forefoot region 30 creates a relatively stiff forefoot as more surface area in the transverse direction is in contact with the ground plane G at any point along the length of the sole structure 10 in the forward roll. Because the entire width of the midsole 14 in the forefoot region 30 is relatively flat in comparison to the protrusions 44, more surface area of the forefoot region 30 may be in contact with the horizontal ground plane G in comparison to just portions of the convex outer surfaces 45 of protrusions 44, so that the forefoot region 30 contributes to a supportive platform for ease of toe-off. To smoothly transition to the more stable platform of the relatively flat portion of the forefoot region 30, the shape of the protrusions 44 goes from relatively elliptical back to relatively round (e.g., at protrusions 44C) and the height of the forwardmost protrusions 44C decreases gradually to zero (e.g., with the forward halves 46 of the forwardmost protrusions 44C being less steep than the rear halves 48).

Accordingly, the compressibility of the protrusions 44 mitigates impact, while the arced profile of the sole structure 10 promotes an efficient transition from heel strike to toe-off. Typically, it is difficult to achieve both of these goals, as increasing compressibility often decreases the efficiency of forward motion (e.g., the wearer must work relatively harder to maintain forward momentum in a highly compressible, cushioned midsole without the arced profile from the heel region 26 to the forefoot region 30). The arced profile helps maintain a more constant angular momentum from the heel strike position of FIG. 7 to the midfoot position of FIG. 8 in comparison to the abrupt increase in angular momentum that may occur with a more typical profile of a sole structure (e.g., a sole structure without an arc upward extending from the midfoot region 28 to the rear of the heel region 26).

Figure 10:
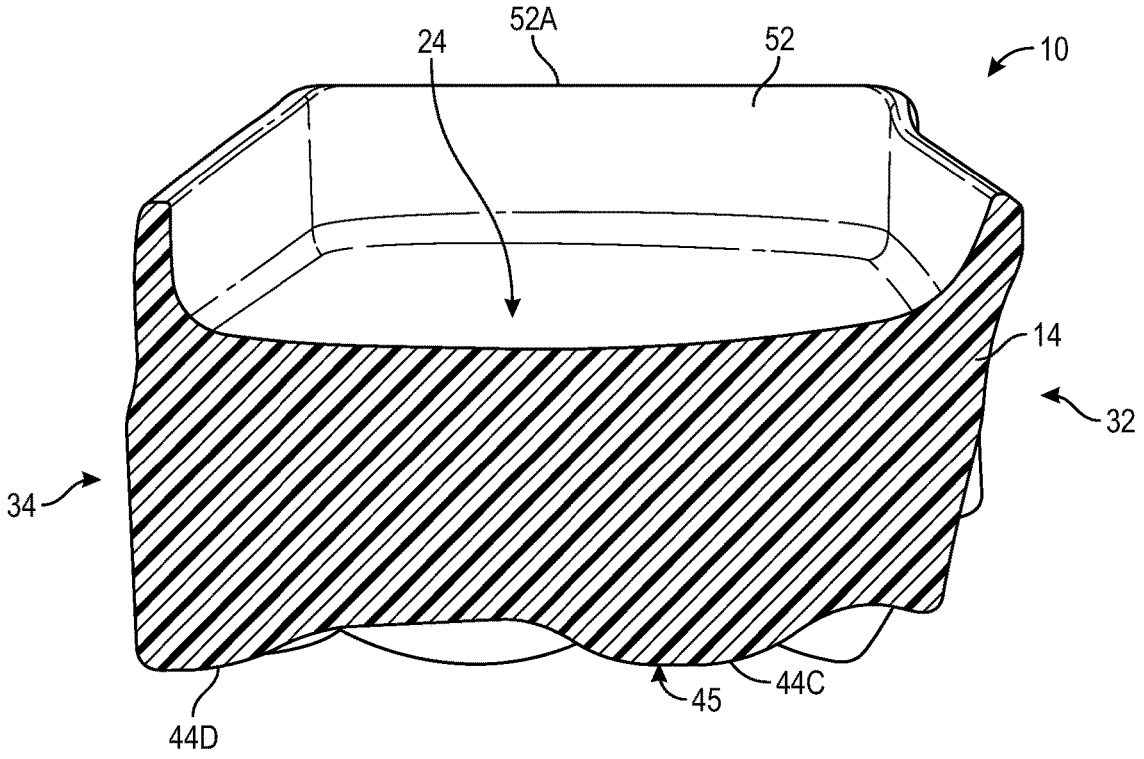
FIG. 10 is a cross-sectional illustration of the sole structure taken at lines 10-10 in FIG. 15.
Figure 11:
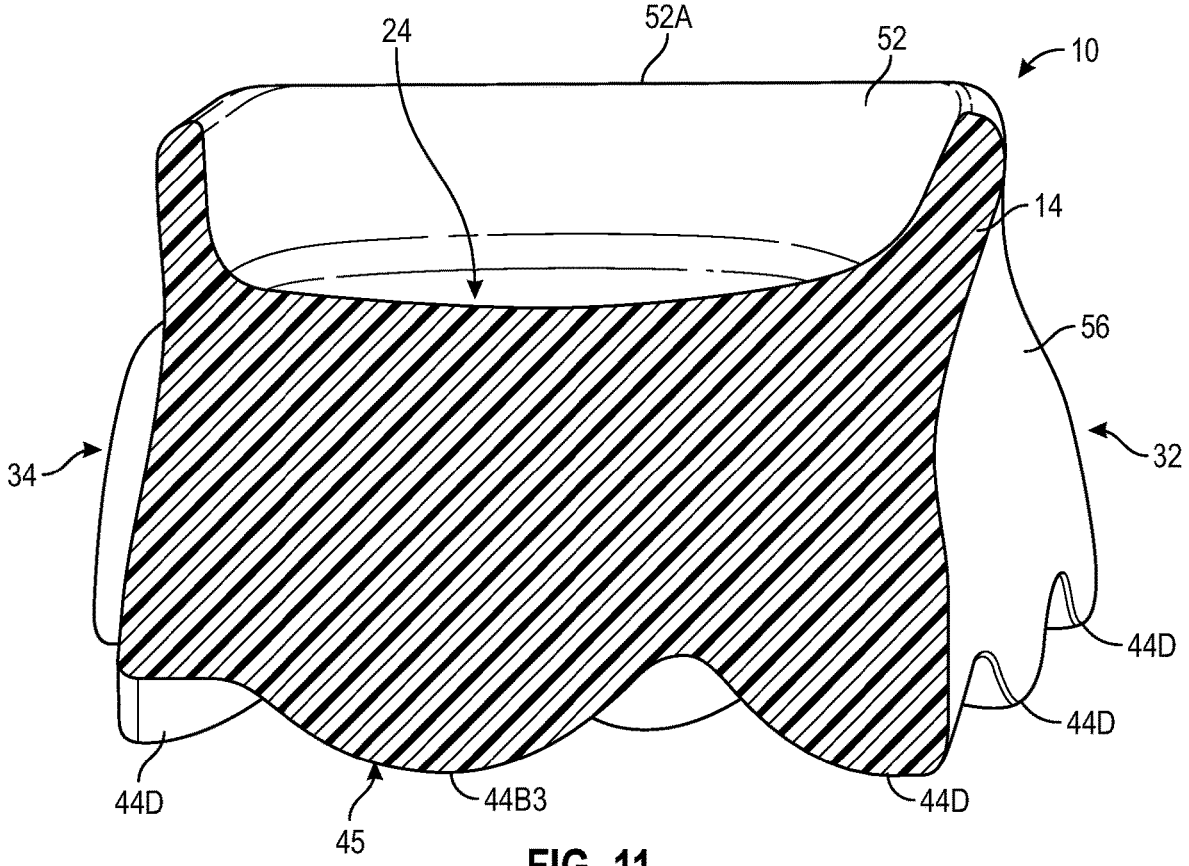
FIG. 11 is a cross-sectional illustration of the sole structure taken at lines 11-11 in FIG. 15.

FIG. 10 is a cross-sectional illustration of the sole structure 10 taken at lines 10-10 in FIG. 15. A relatively short protrusion 44C at the forward portion of the midfoot region 28 is shown, with the cross-section taken forward of the peak 50 so that the full height is not apparent. FIG. 11 is a cross-sectional illustration of the sole structure 10 taken at lines 11-11 in FIG. 15. The flaring side wall 56 and the truncated peripheral protrusions 44D are apparent, as well as the relatively tall height of the protrusion 44B3 in comparison to the more forward protrusion 44C of FIG. 10.

Figure 12:
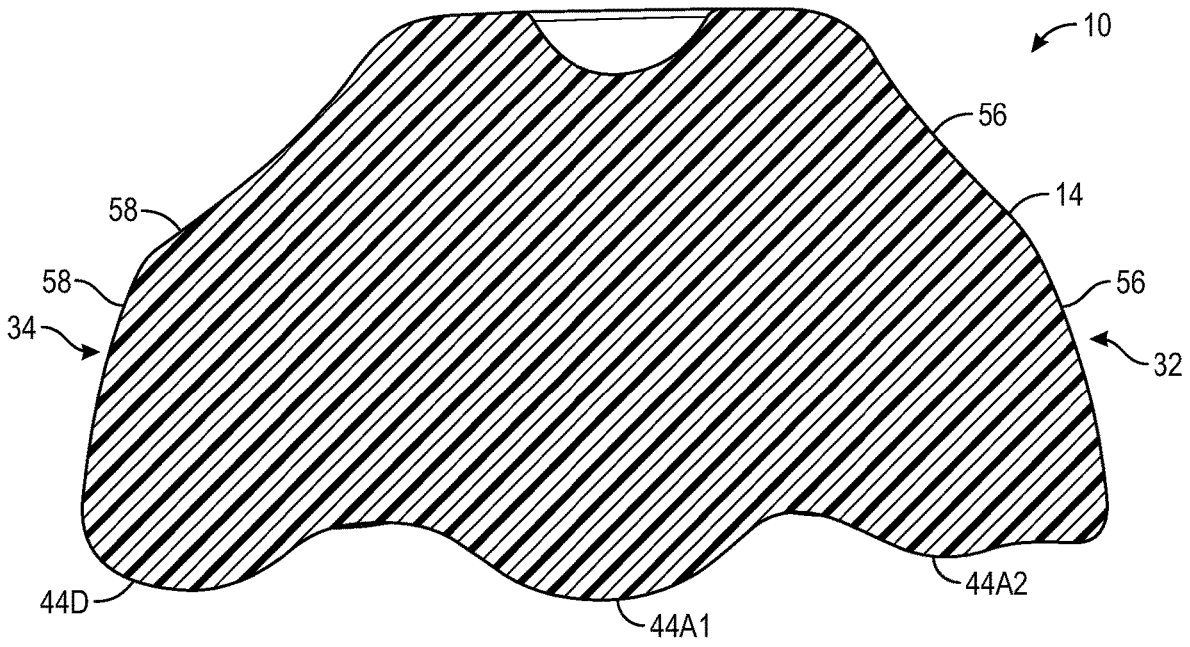
FIG. 12 is a cross-sectional illustration of the sole structure taken at lines 12-12 in FIG. 15.

FIG. 12 is a cross-sectional illustration of the sole structure taken at lines 12-12 in FIG. 15. The relatively rounder and shorter protrusion 44A1 is shown, and the cross-section is taken rearward of the peak of protrusion 44A2 and illustrates the partially truncated peripheral protrusion 44D. As the rearmost truncated peripheral protrusions 44D are disposed higher than the protrusion 44A1 due to the arced profile apparent in FIG. 3, these are not visible in the cross-section taken.

Figure 13:
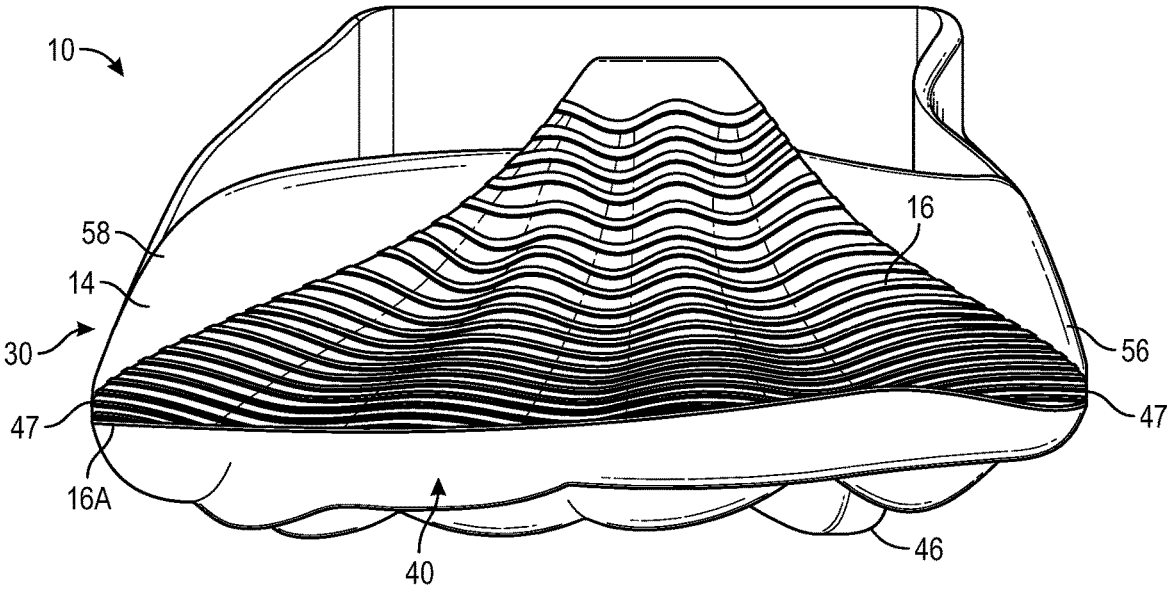
FIG. 13 is a front view of the sole structure.

FIG. 13 is a front view of the sole structure 10, showing the lateral side wall 58 flaring outward and the medial side wall 56 flaring outward. The outsole element 16 is shown with a rear extent generally at the widest portions 47 of the midsole 14. The medial side wall 56 and lateral side wall 58 flaring outward from an upper extent to a lower extent are apparent in the forefoot region 30 shown in FIG. 13.

FIG. 14 is a rear view of the sole structure 10, showing the truncated peripheral protrusions 44D providing a broad platform in the transverse direction to avoid medial-lateral motion. FIG. 15 is a top view of the sole structure 10 indicating the flaring medial and lateral side walls 56, 58 and rear side wall 52 in the heel region 26.

Figure 16:
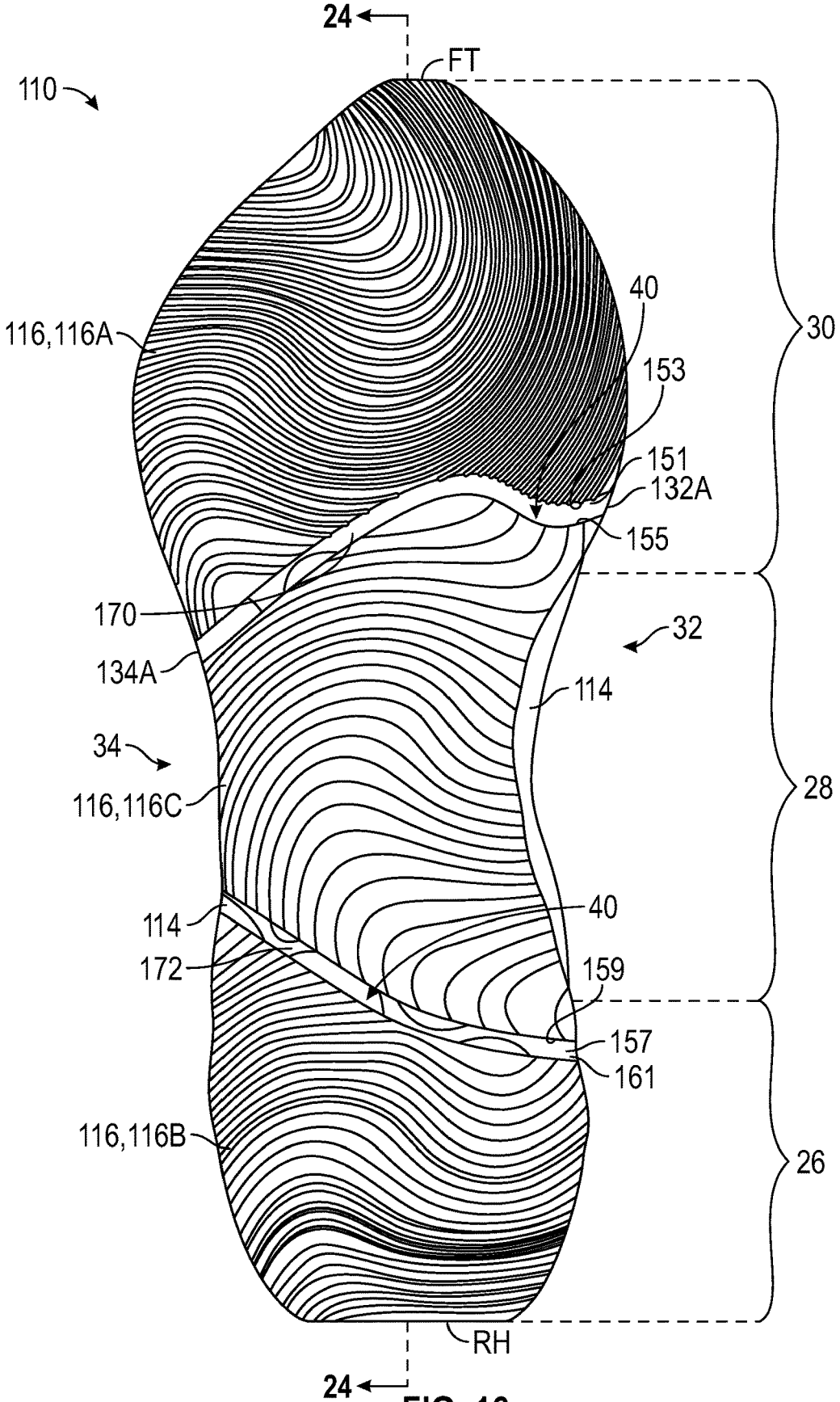
FIG. 16 is a bottom view of another embodiment of a sole structure for an article of footwear including a midsole and an outsole.

FIG. 16 shows another embodiment of a sole structure 110 that may be used in the article of footwear 12 of FIG. 7 in place of sole structure 10. The sole structure 110 has many of the same features as described with respect to the sole structure 10, and these features are indicated with like reference numbers. Like sole structure 10, the sole structure 110 includes a midsole 114 that has a plurality of downwardly-extending protrusions 44 (see FIGS. 17-19 and 24, for example) that mitigate impact, and has an arced profile to promote efficient transition from heel strike to toe-off. As further discussed herein, the sole structure 110 also includes an outsole 116 covering at least a portion of the ground-facing surface 40 of the midsole 114. In the embodiment shown, the outsole 116 has a first outsole element 116A, a second outsole element 116B, and a third outsole element 116C, also referred to herein as a first outsole portion, a second outsole portion, and a third outsole portion, respectively.

The first outsole element 116A is secured to and covers at least part of the ground-facing surface 40 of the midsole 114 in the forefoot region 30. The first outsole element 116A is also referred to as a forefoot outsole element 116A. The second outsole element 116B is secured to and covers at least part of the ground-facing surface 40 of the midsole 114 in the heel region 26. The second outsole element 116B is also referred to as a heel outsole element 116B. The third outsole element 116C is secured to and covers at least part of the ground-facing surface 40 of the midsole 114 in the midfoot region 28. The third outsole element 116C is also referred to as a midfoot outsole element 116C. As best shown in FIGS. 28-31, each of the forefoot outsole element 116A, the midfoot outsole element 116C, and the heel outsole element 116B extend from the medial side wall 56 to the lateral side wall 58 of the midsole 114.

Figure 20:
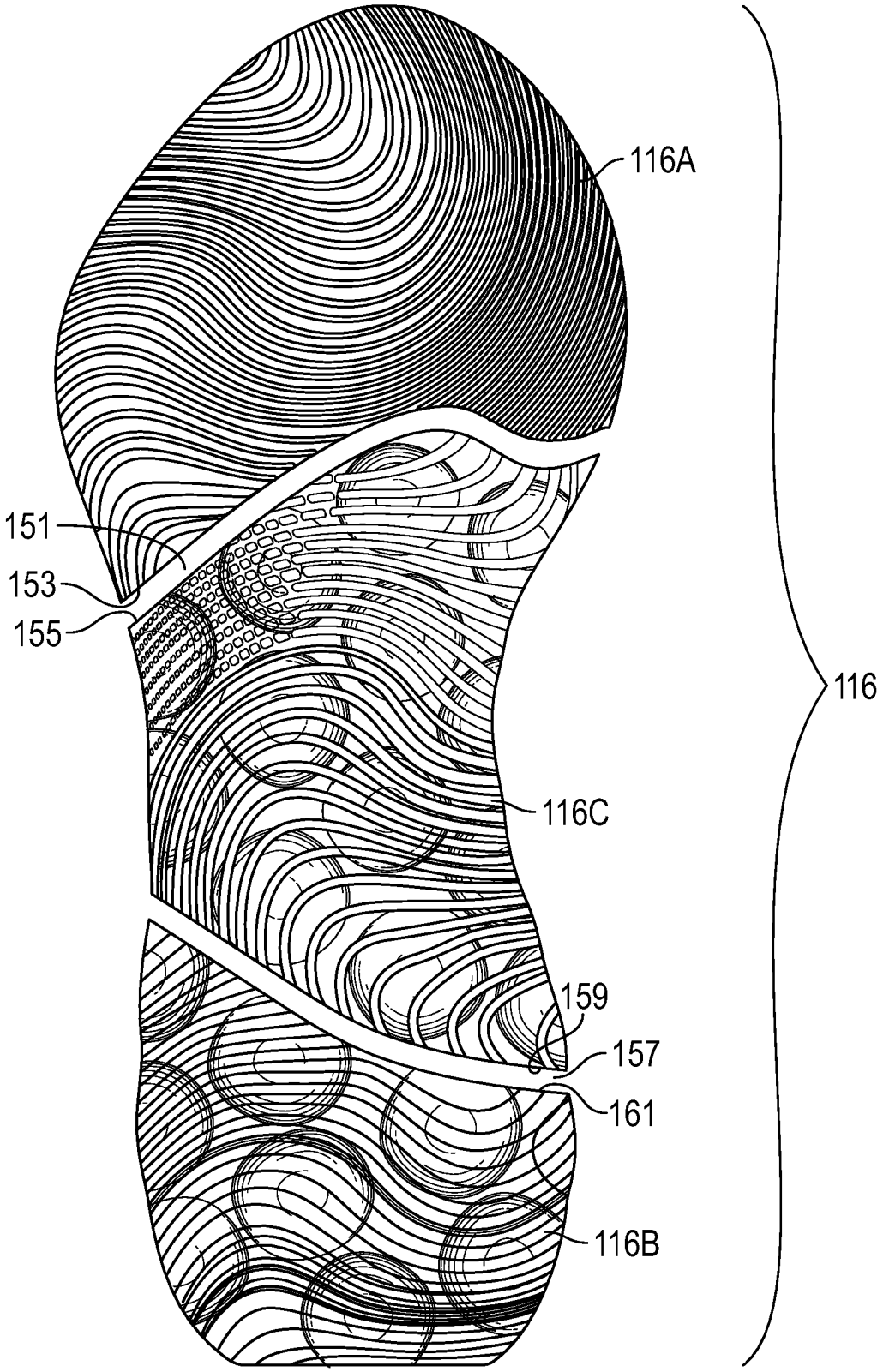
FIG. 20 is a bottom view of the outsole of the sole structure of FIG. 16.
Figure 21:
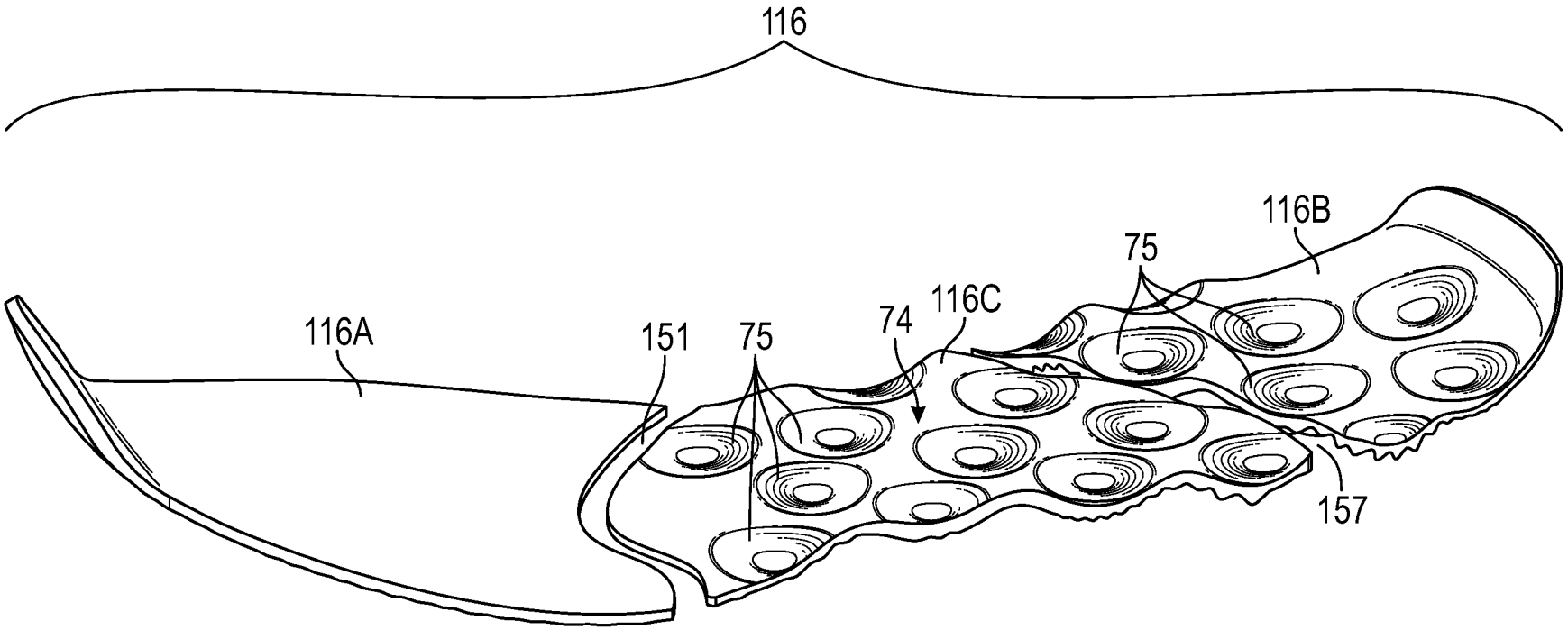
FIG. 21 is a perspective view of the outsole of the sole structure of FIG. 16.
Figure 22:
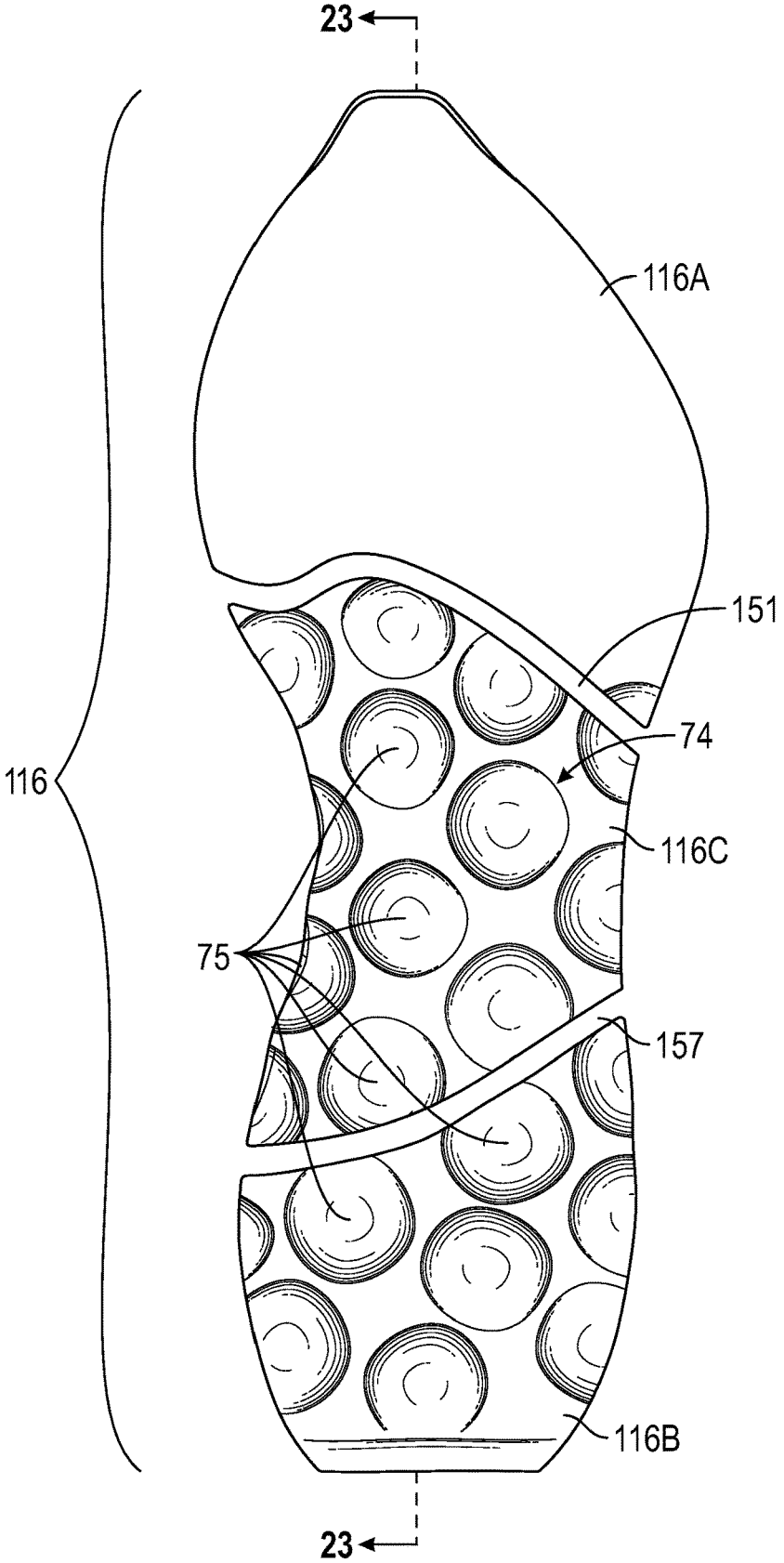
FIG. 22 is a top view of the outsole of the sole structure of FIG. 16.
Figure 23:
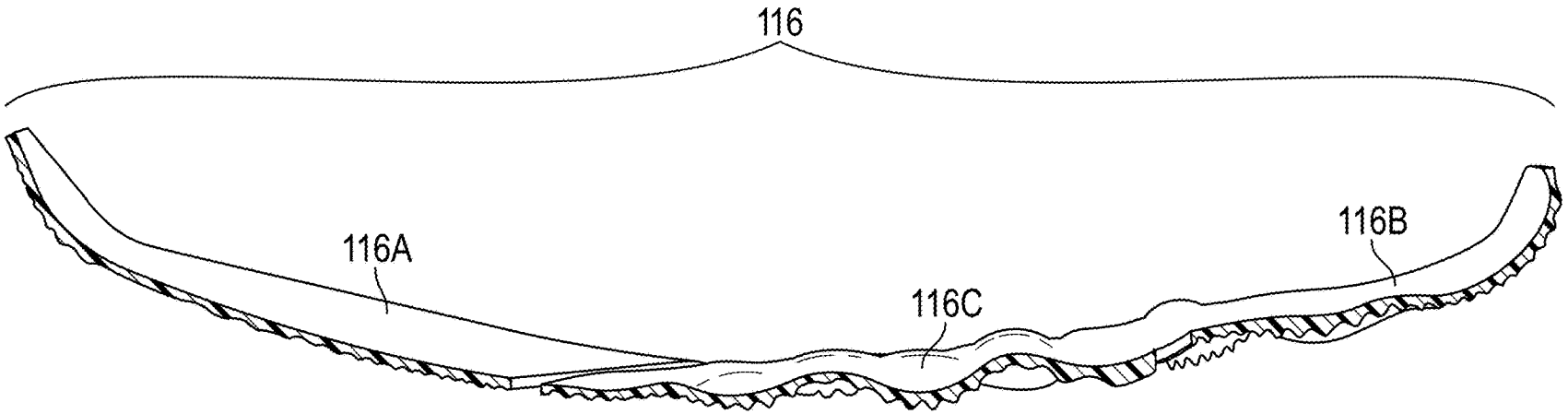
FIG. 23 is a cross-sectional view of the outsole of FIG. 16 taken at lines 23-23 in FIG. 22.

As shown in FIG. 16, the first outsole element 116A and the third outsole element 116C are separated by a first gap 151 extending from a medial edge 132A to a lateral edge 134A of the midsole 114. The medial edge 132A is also referred to as a medial side edge of the ground-facing surface 40, and the lateral edge 134A is also referred to as a lateral side edge of the ground-facing surface 40. FIGS. 20, 21, and 22 also depict the first gap 151. Stated differently, a rear edge 153 of the first outsole element 116A (e.g., the forefoot outsole element) is spaced apart from a forward edge 155 of the third outsole element 116C (e.g., the midfoot outsole element) defining the first gap 151 between the rear edge 153 and the forward edge 155.

The rear edge 153 of the first outsole element 116A has an irregular shape. As used herein, an irregular shape is a nonlinear shape. The forward edge 155 of the third outsole element 116C has a complementary irregular shape that tracks the irregular shape of the rear edge 153 of the first outsole element 116A. As used herein, an edge has a complementary irregular shape that tracks an irregular shape of another edge when the edges can be spaced apart from one another by a gap of a substantially constant width. For example, a substantially constant width of a gap may be a gap with a width that varies by not more than 20 percent along a length of the gap. As shown in FIGS. 16, 20, 21, and 22, the first gap 151 has a substantially constant width.

Similarly, the second outsole element 116B and the third outsole element 116C are separated by a second gap 157 extending from the medial edge 132A to the lateral edge 134A of the midsole 114. Stated differently, a rear edge 159 of the third outsole element 116C (e.g., the midfoot outsole element) is spaced apart from a forward edge 161 of the second outsole element 116B (e.g., the heel outsole element) defining the second gap 157 between the rear edge 159 and the forward edge 161.

The forward edge 161 of the second outsole element 116B has an irregular shape, and the rear edge 159 of the third outsole element 116C has a complementary irregular shape that tracks the irregular shape of the forward edge 161 of the heel outsole element. Accordingly, the second gap 157 is of a substantially constant width.

Figure 18:
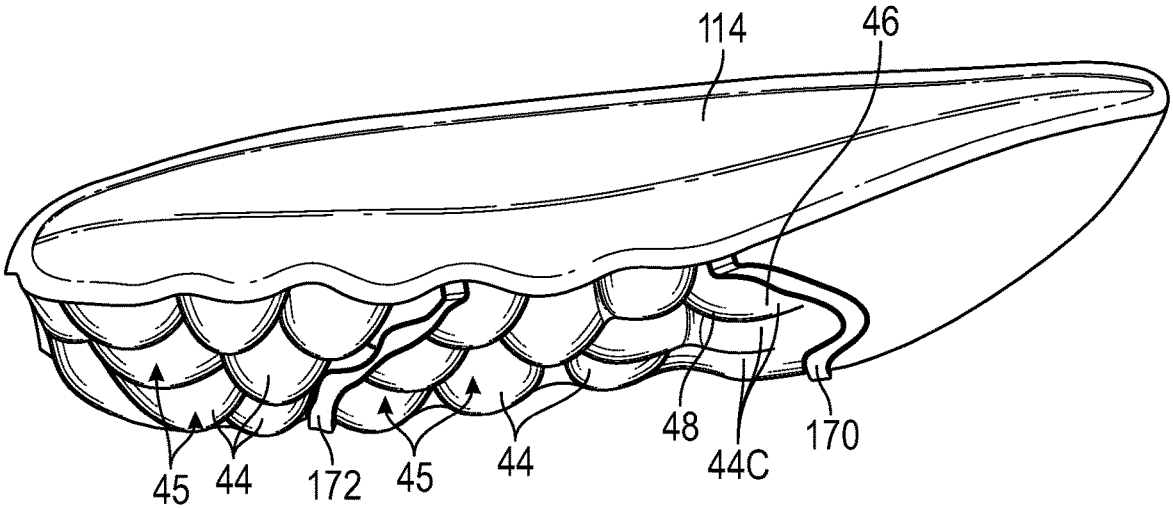
FIG. 18 is a perspective view of the midsole of the sole structure of FIG. 16.
Figure 19:
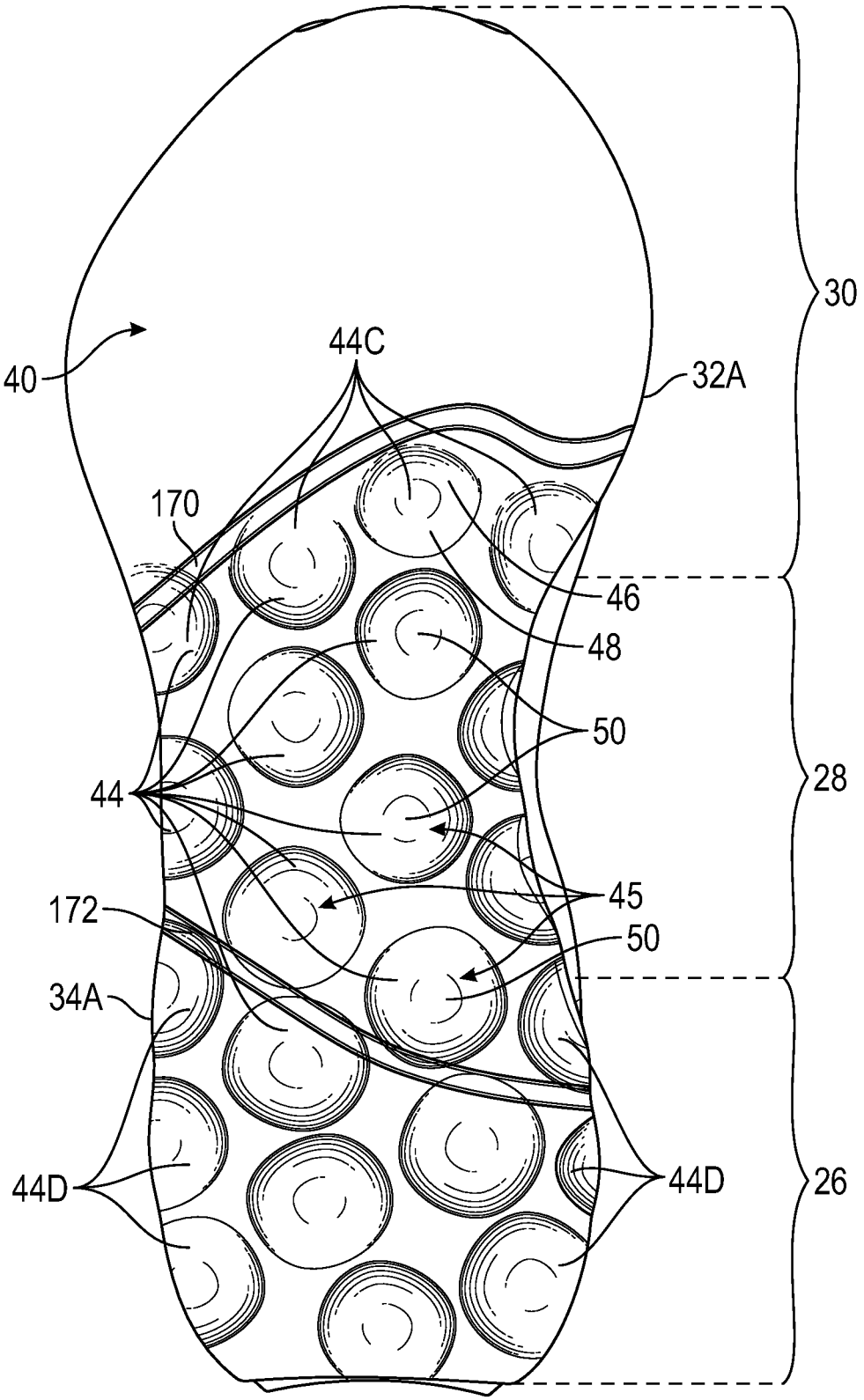
FIG. 19 is a bottom view of the midsole of the sole structure of FIG. 16.
Figure 24:
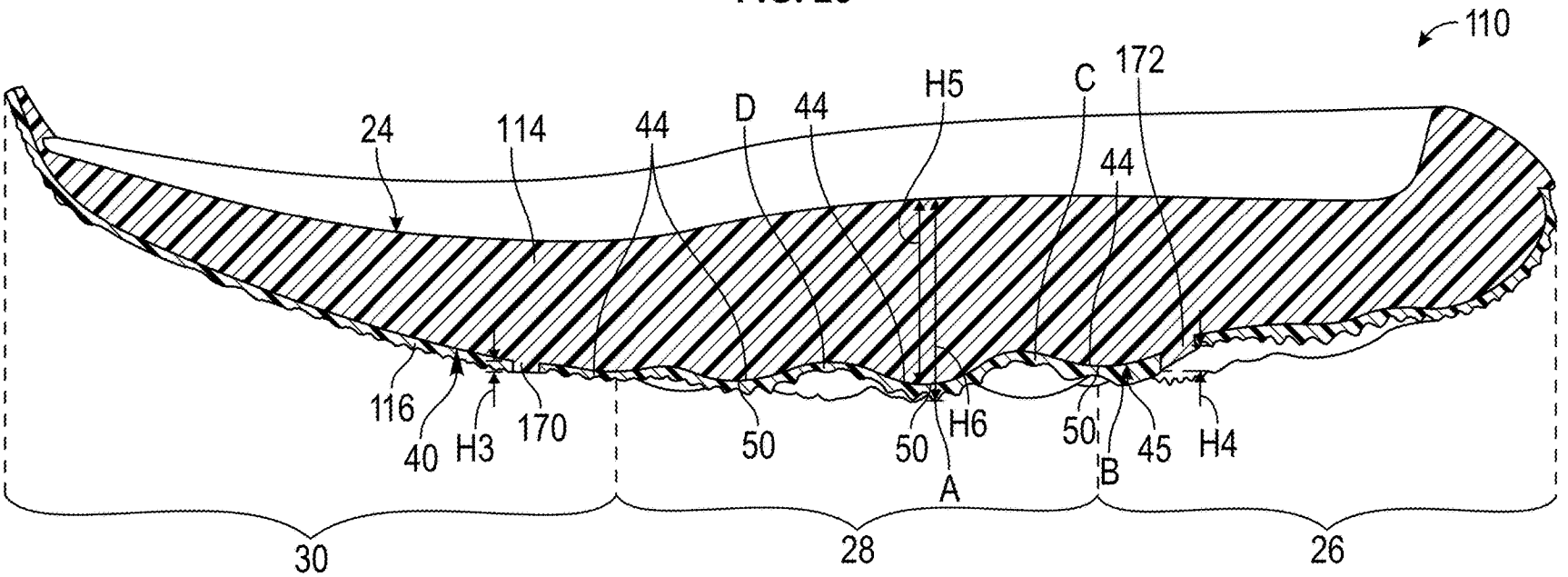
FIG. 24 is a cross-sectional view of the sole structure of FIG. 16 taken at lines 24-24 in FIG. 16.

As best shown in FIGS. 18, 19 and 24, the midsole 114 includes a first ridge 170 and a second ridge 172. The first ridge 170 and the second ridge 172 protrude downward and form part of the ground-facing surface 40. The first ridge 170 and the second ridge 172 extending downward from the contoured downwardly-extending protrusions 44 by an amount H3, H4, respectively that may vary along each of the ridges 170, 172. Stated differently, the ridges 170, 172 follow the contours of the downwardly-extending protrusions 44 in the vertical direction while also following the contours of the gaps 151, 157 respectively, in the horizontal direction.

Figure 17:
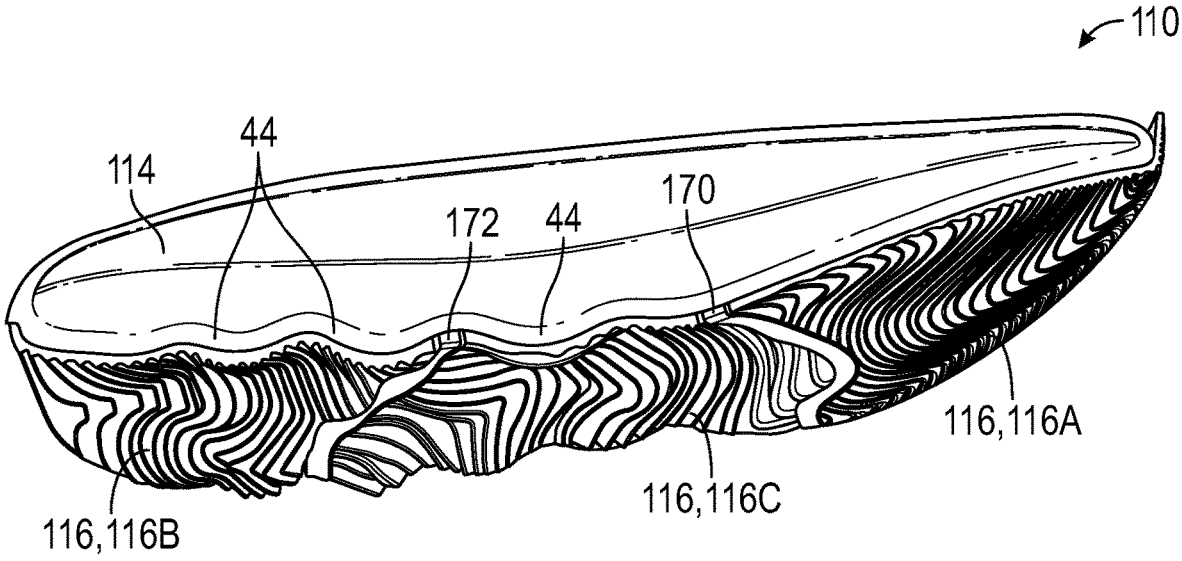
FIG. 17 is a perspective view of the sole structure of FIG. 16.

As shown in FIGS. 16, 17, and 24, the first ridge 170 extends into and at least partially fills the first gap 151. Similarly, the second ridge 172 extends into and at least partially fills the second gap 157.

The configuration of the outsole 116 having two or more discrete outsole elements separated from one another (such as any two of or all of the outsole elements 116A, 116B, and 116C) constrains the midsole 114 less than would an embodiment in which a one-piece outsole extends across most or all of the ground-facing surface 40 of the midsole 114. The midsole 114 as shown in a one-piece foam body that may be any of the materials described with respect to midsole 14. The outsole 116 may be any of the materials described with respect to outsole 16. The midsole 114 may thus be of a material that is more compressible and flexible than the outsole 116. The gaps 151, 157 allow greater movement of the midsole 114 during compression and dorsiflexion, for example, than if the outsole 116 extended without gaps along the ground-facing surface 40 from the rear extent of the heel region 26 (e.g., the rearmost heel location RH) to the front extent of the forefoot region 30 (e.g., the foremost toe location FT). By providing edges of adjacent outsole elements that are complementary and track one another, the competing goals of covering much of the ground-facing surface 40 of the midsole 114 with the outsole 116 to increase durability and allowing flexibility and deformation of the protrusions 44 of the midsole 114 without excessive constraint by the outsole 116 may both be achieved.

Referring to FIG. 24, a height H5 of the midsole 114 is greatest at the midfoot region 28. The height of the midsole 114 varies given the undulating protrusions 44, but is consistently greater at the peaks 50 of the protrusions 44 in the midfoot region 28 than at the peaks 50 of the protrusions 44 in the heel region 26. The height of the midsole 114 at any location is measured from the foot-facing surface to the ground-facing surface 40. The height of the midsole 114 is also greater at the peaks 50 of the protrusions 44 in the midfoot region 28 than in the forefoot region 30. The outsole 116 is configured so that the height H6 of the sole structure 110 is also greatest at the midfoot region 28. Stated differently, the height of the sole structure 110, including the height of both the midsole 114 and the outsole 116, is greatest at the midfoot region 28. Accordingly, like the midsole 114, the sole structure 110 (including both the midsole 114 and the outsole 116) also has an arced profile.

Such an embodiment enables a "rocker" functionality of the midsole 114. For example, the ground-facing surface 40 of the midsole 114 curves upwardly from the midfoot region 28 to a forward extent of the midsole 114 and from the midfoot region 28 to a rear extent of the midsole 114, establishing an arced profile of the midsole 114. As discussed with respect to midsole 14, with such a full-length, convex camber, only a relatively small area of the ground-facing surface of the outsole 116 is in contact with a horizontal ground plane at any time during the stride, and the rate of transitioning forward on the sole structure 110 is relatively constant in comparison to sole structures configured so that a large portion of the midfoot region 28 comes into contact with the ground very abruptly upon transition from a heel region 26 to a midfoot region 28, for example. The full-length convex camber helps to avoid a "slapping" phenomena and associated foot fatigue.

With reference to FIGS. 19 and 24, in contrast to the midfoot region 28 and heel region 26 having the downwardly-extending protrusions 44, the ground-facing surface 40 of the forefoot region 30 is relatively flat. To provide a stable platform for toe-off from the forefoot region 30, downwardly-extending protrusions 44 may be absent from at least a forward half of the forefoot region 30.

Referring again to FIGS. 19 and 24, the downwardly-extending protrusions 44 are distributed over the midfoot region 28 and the heel region 26. Like midsole 14, each of the downwardly-extending protrusions 44 has a convex outer surface 45 and a peak 50. Only some of these are indicated with reference numbers in FIGS. 19 and 24. In contrast to the midsole 14, however, the downwardly-extending protrusions 44 in the midfoot region 28 of the midsole 114 have width-to-length ratios similar to those of the downwardly-extending protrusions in the forefoot region 30 and the heel region 26. In other words, like those in the forefoot region 30 and heel region 26, the protrusions 44 in the midfoot region 28 (e.g., midfoot protrusions 44B) are relatively round rather than elongated. The protrusions 44 in the midfoot region 28 have widths in a transverse direction of the midsole 114 that are approximately the same as or may be equal to lengths in a longitudinal direction of the midsole 114, and protrusions 44 in the heel region 26 (e.g., heel protrusions 44A) have width-to-length ratios that are relatively the same as the width-to-length ratios of the protrusions 44 in the midfoot region 28.

Referring to FIG. 19, like midsole 14, the downwardly-extending protrusions 44 in the forefoot region 30 include forwardmost protrusions 44C each having a front half 46 and a rear half 48, and the convex outer surface 45 is steeper at the rear half 48 than at the front half 46, enabling the forward roll of the foot to smoothly transition from the undulating midfoot region 28 to the relatively flat forefoot region 30.

As best shown in FIG. 24, the outsole 116 is thicker where it aligns with and is secured to the peaks 50 of the downwardly-extending protrusions 44 than at the ground-facing surface 40 of the midsole 114 between adjacent peaks 50. For example, the outsole 116 at areas A and B (at peaks 50) is thicker than the outsole at areas C and D (between adjacent peaks 50). The material of the outsole 116 may be relatively durable in comparison to the material of the midsole 114, and the thickness at the peaks 50 aids in durability of the sole structure 110, slowing wear. The material of the midsole 114 may be relatively more compressible than the outsole 116, and the relative thinness of the outsole 116 between the peaks 50 may therefore enable greater movement and deformation of the downwardly-extending protrusions 44 during compression in comparison to a thicker outsole between the peaks 50. Stated differently, an outsole 116 with relatively thin areas between the peaks 50 constrains the midsole 114 less than if the material between the peaks 50 were thicker, allowing greater resilient deformation and related cushioning. As is evident in FIGS. 21 and 22, the outsole 116 is preformed with these relatively thick and thin areas, and with an undulating inner or top surface 74 (e.g., foot-facing surface 74) having recesses 75 that align with and cup the protrusions 44 when the outsole 116 is assembled to the ground-facing surface 40 of the midsole 114. Only some of the recesses 75 are labelled in FIGS. 21-22. Because the outsole 116 is preformed with this three-dimensional, undulating shape rather than being a flat piece molded onto the midsole 114 to obtain the undulating shape, there may be less tendency for the protrusions 44 to be compressed or otherwise deformed by the outsole 116 during attachment of the outsole 116 to the midsole 114, allowing the midsole 114 to thus function in accordance with its intended shape during use.

Figure 25:
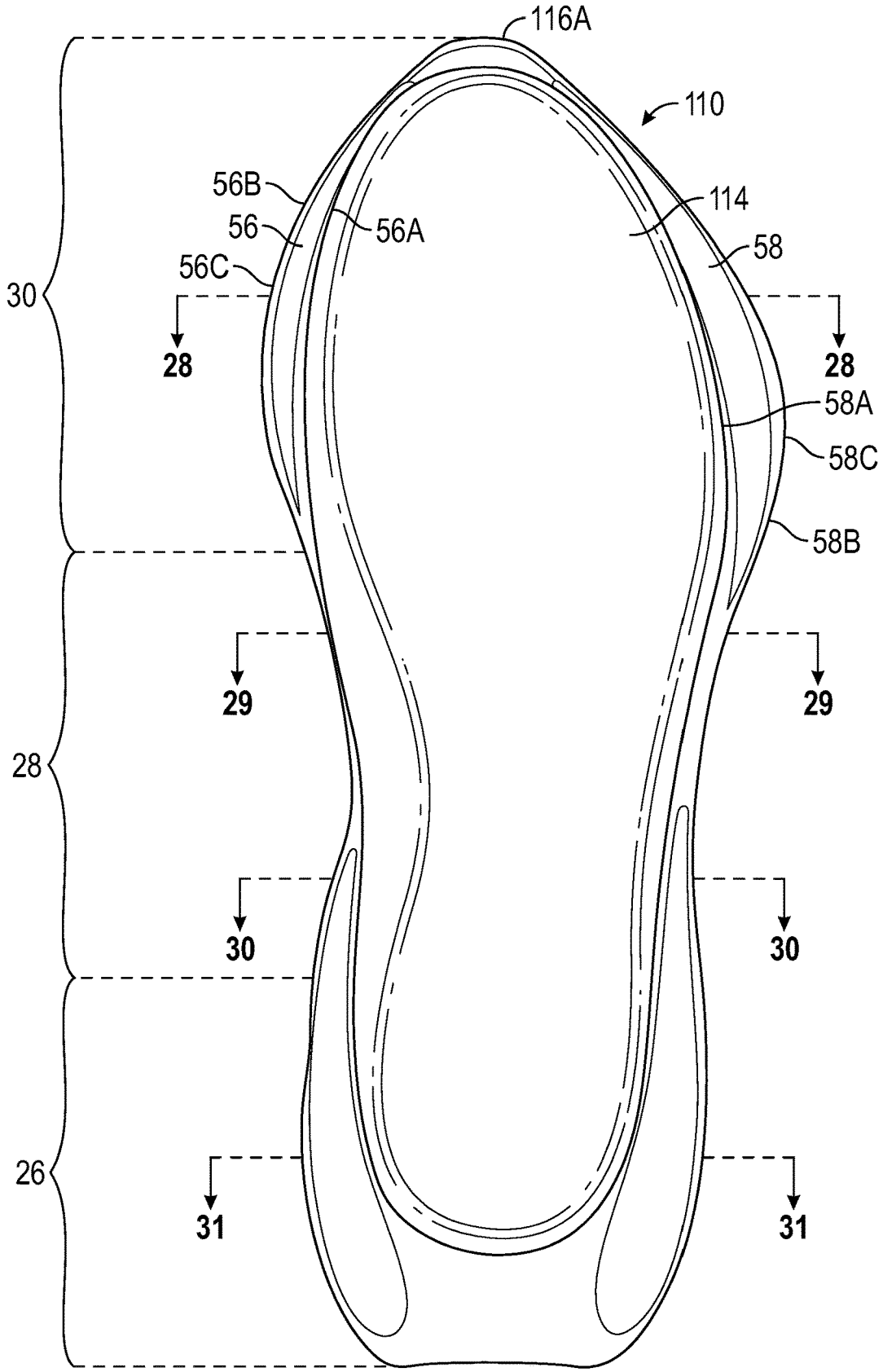
FIG. 25 is a top view of the sole structure of FIG. 16.
Figure 26:
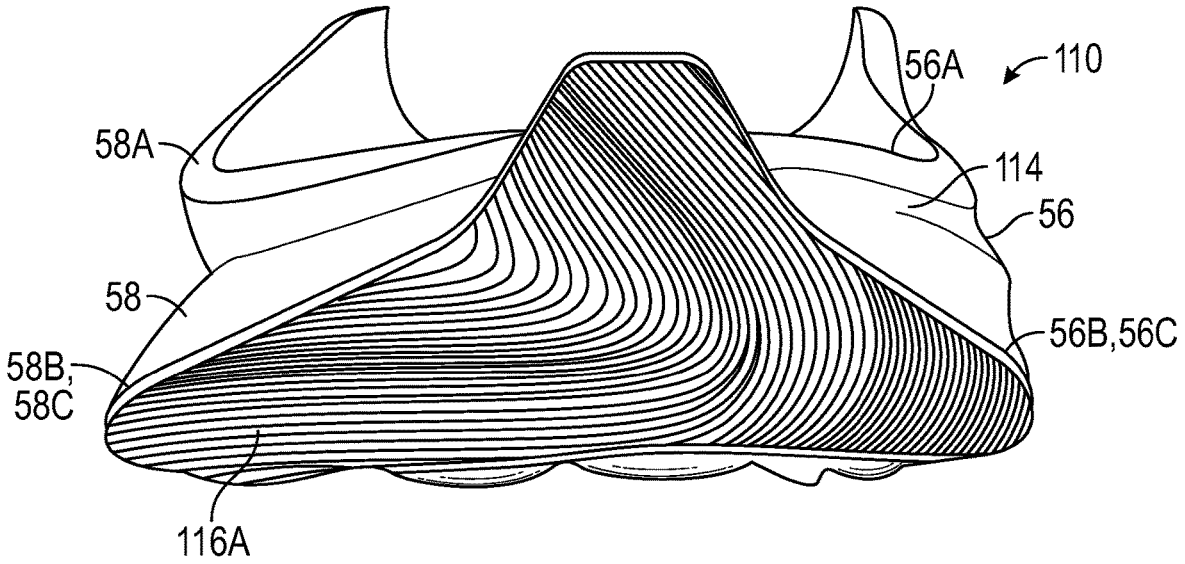
FIG. 26 is a front view of the sole structure of FIG. 16.
Figure 27:
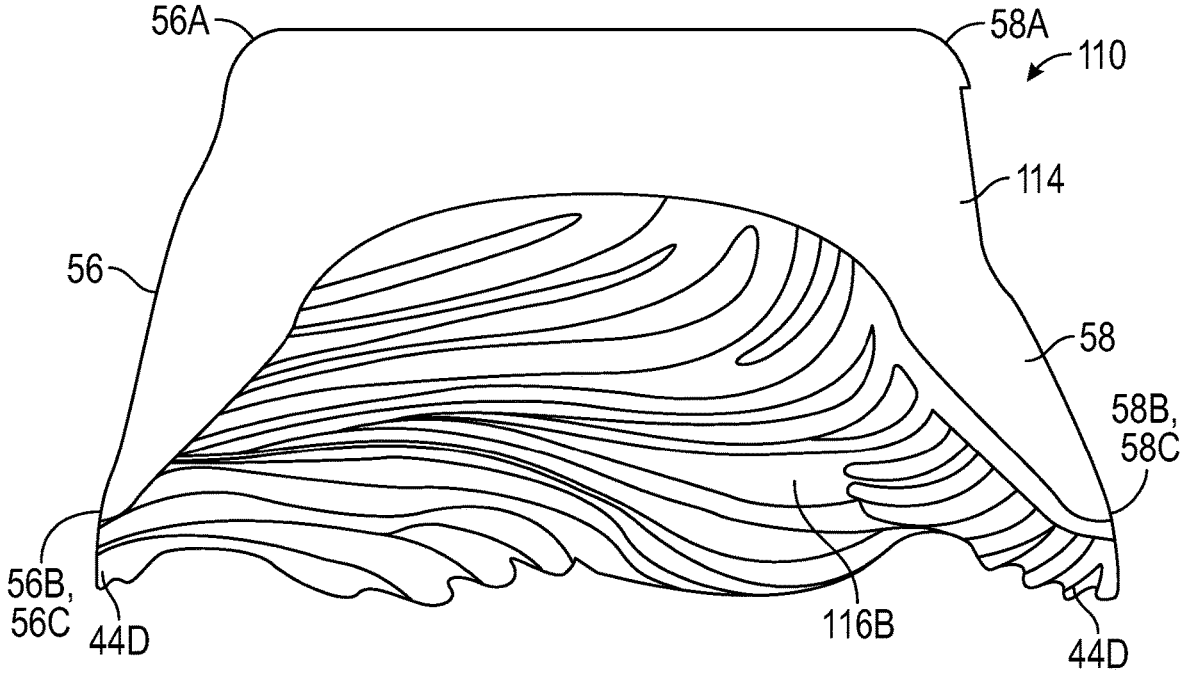
FIG. 27 is a rear view of the sole structure of FIG. 16.
Figure 28:
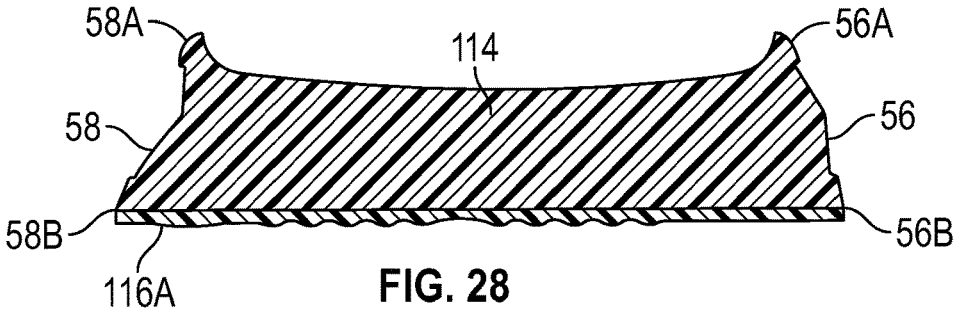
FIG. 28 is a cross-sectional view of the sole structure of FIG. 16 taken at lines 28-28 in FIG. 25.
Figure 29:
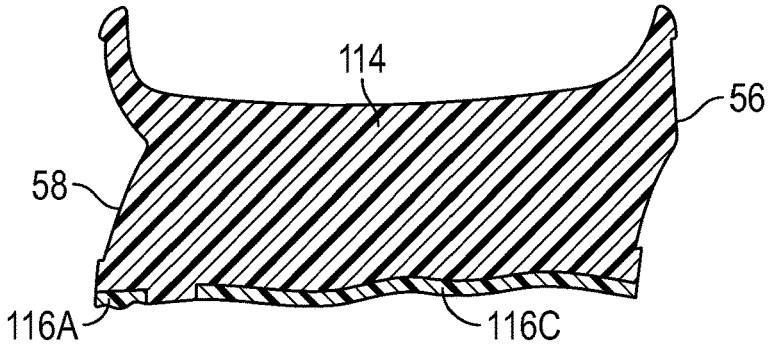
FIG. 29 is a cross-sectional view of the sole structure of FIG. 16 taken at lines 29-29 in FIG. 25.
Figure 30:
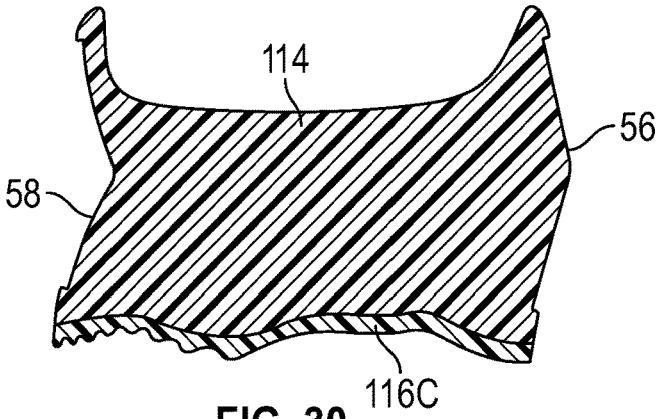
FIG. 30 is a cross-sectional view of the sole structure of FIG. 16 taken at lines 30-30 in FIG. 25.
Figure 31:
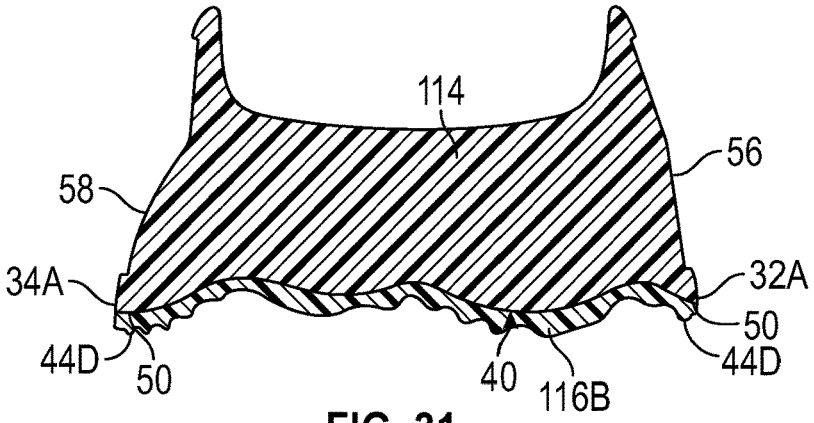
FIG. 31 is a cross-sectional view of the sole structure of FIG. 16 taken at lines 31-31 in FIG. 25.

Like midsole 14, the midsole 114 includes a lateral side wall 58 and a medial side wall 56, each of which has an upper extent and a lower extent and each of which flares outward from the upper extent to the lower extent in both the forefoot region 30 (see, e.g., FIGS. 25, 26, and 28) and the heel region 26 (see, e.g., FIGS. 25, 27, and 31). Specifically, the medial side wall 56 flares outward from an upper extent 56A to a lower extent 56B, and the lateral side wall 58 flares outward from an upper extent 58A to a lower extent 58B. Accordingly, the forefoot region 30 is relatively flat and wide to provide stability. The height of the midsole 114 in the forefoot region 30 should be sufficient to provide adequate cushioning, while the relative flatness of the foam (absence of the downwardly-extending protrusions 44) makes this region relatively stiff in comparison to other regions to provide support for an efficient toe-off. Similarly, the heel region 26 flares outward to be sufficiently wide at the lower extents 56B, 58B of the side walls 56, 58 to provide stability.

Referring again to FIGS. 25-27, the medial side wall 56 has a lower medial side edge 56C at the lower extent 56B extending from the forefoot region 30 to the heel region 26. The lateral side wall 58 has a lower lateral side edge 58C at the lower extent 58B extending from the forefoot region 30 to the heel region 26. The outsole 116 (including outsole elements 116A, 116B, and 116C) extends to and underlies the medial side edge 56C and the lateral side edge 58C, terminating at the medial side edge 56C and the lateral side edge 58C without extending onto the medial side wall 56 and the lateral side wall 58. Stated differently, the outsole 116 does not wrap upward along the side walls 56, 58. By not extending onto the medial side wall 56 and the lateral side wall 58, the midsole 114 is less constrained by the outsole 116 at the side walls 56, 58 and may resiliently deform to a greater degree, potentially providing greater cushioning.

Like midsole 14, for stability in the midfoot region 28 given the convex outer surfaces 45 of the downwardly-extending protrusions 44, the downwardly-extending protrusions 44 include truncated peripheral protrusions 44D in the midfoot region 28 and the heel region 26 that define a lateral side edge 34A and a medial side edge 32A of the ground-facing surface 40 of the midsole 114, as shown in FIG. 31. The peripheral protrusions 44D are truncated in that they each have only about half of a convex outer surface 45 in comparison to the midfoot protrusions 44B and heel protrusions 44A that are not truncated, as peaks 50 of the truncated peripheral protrusions 44D lie along the lateral side edge 34A and the medial side edge 32A. Providing peaks 50 along the edges 32A and 34A broadens the width between the two furthest peaks 50 in contact with the ground plane G during the forward stride, increasing medial-lateral stability. Providing peaks 50 along the edges 32A, 34A helps to limit the extent of medial-lateral tilt that could occur regardless of whether initial impact is on a non-truncated, fully convex protrusion 44.

Figure 32:
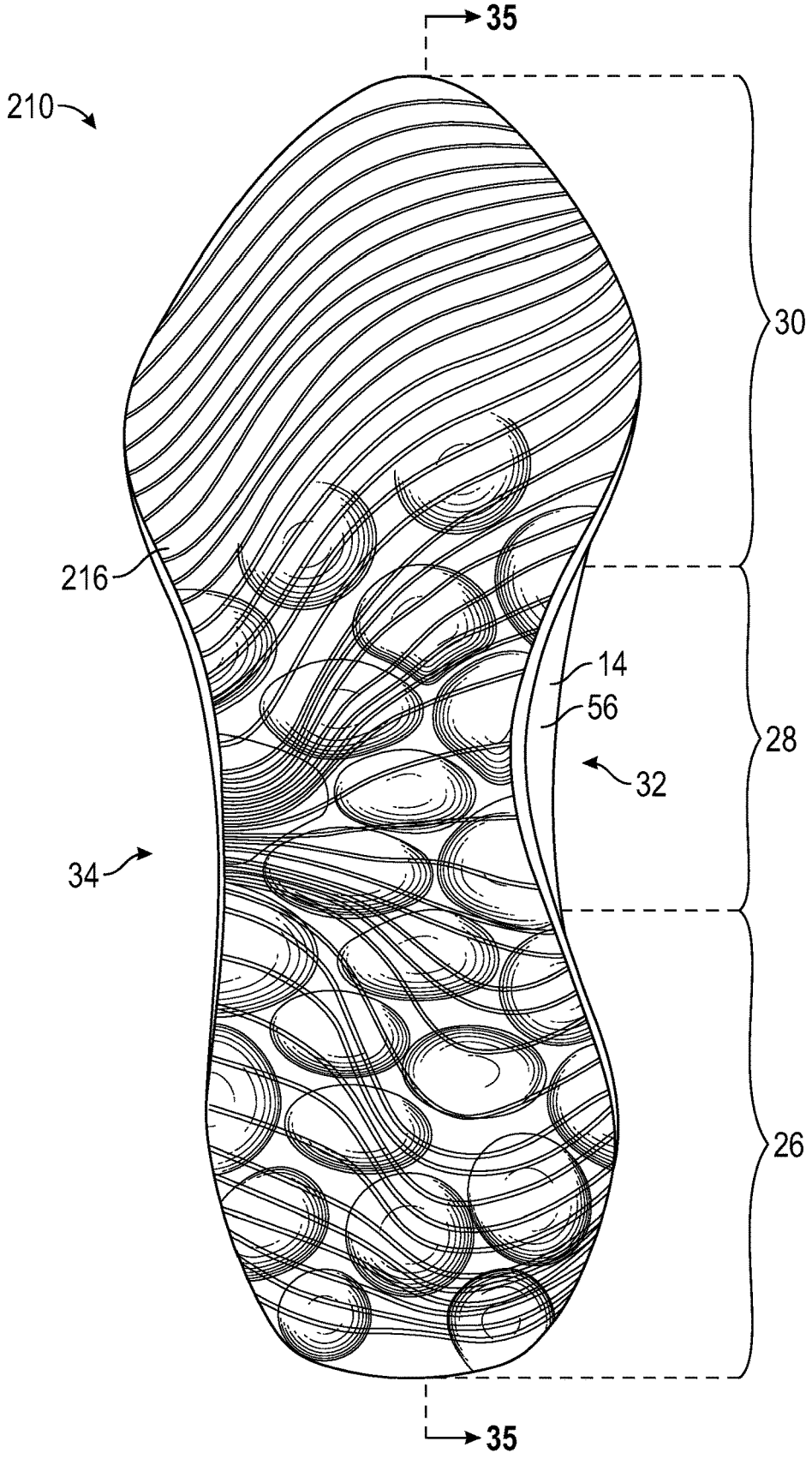
FIG. 32 is a bottom view of another embodiment of a sole structure for an article of footwear including a midsole and an outsole.

FIG. 32 shows another embodiment of a sole structure 210 that may be used in place of the sole structure 10 in the article of footwear 12. The sole structure 210 has the same midsole 14 as described with respect to sole structure 10, but includes a one-piece outsole 216 that covers the ground-facing surface 40 of the midsole 14 in each of the forefoot region 30, the midfoot region 28, and the heel region 26, and establishes the ground-engaging surface of the sole structure 210. The one-piece outsole 216 may entirely cover each of these regions so that no portion of the ground-facing surface 40 of the midsole 14 is a ground-engaging surface of the sole structure 210.

Figure 33:
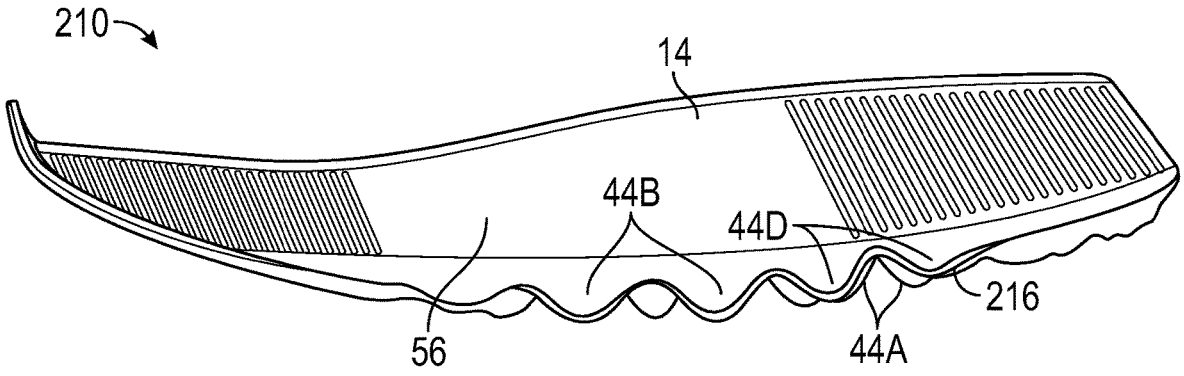
FIG. 33 is a medial side view of the sole structure of FIG. 32.
Figure 34:
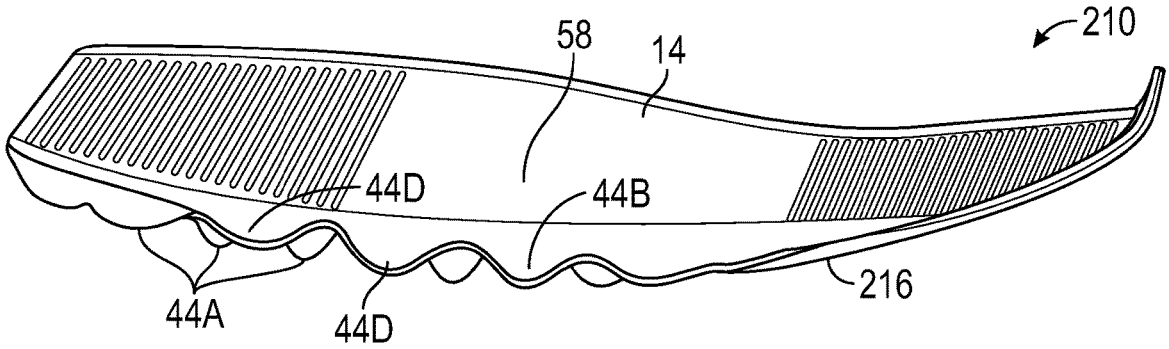
FIG. 34 is a lateral side view of the sole structure of FIG. 32.
Figure 35:
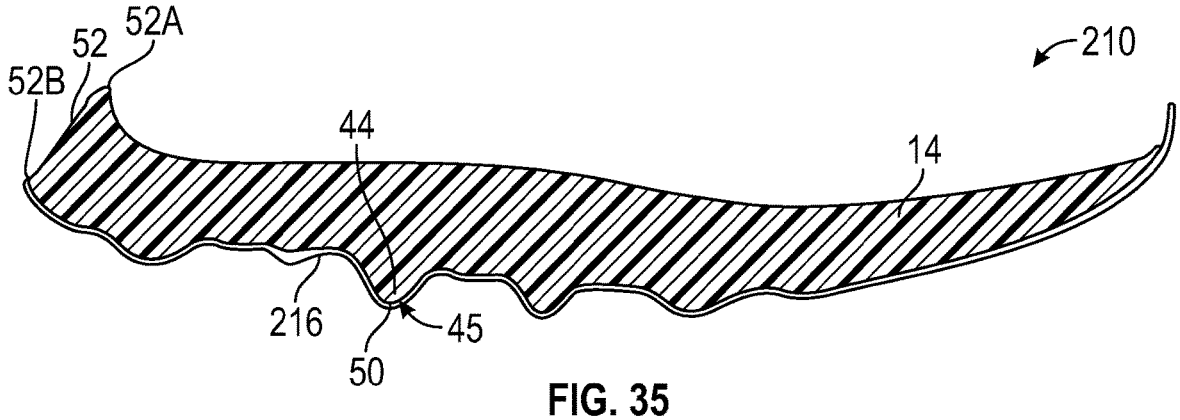
FIG. 35 is a cross-sectional view of the sole structure of FIG. 32 taken at lines 35-35 in FIG. 32.
Figure 36:
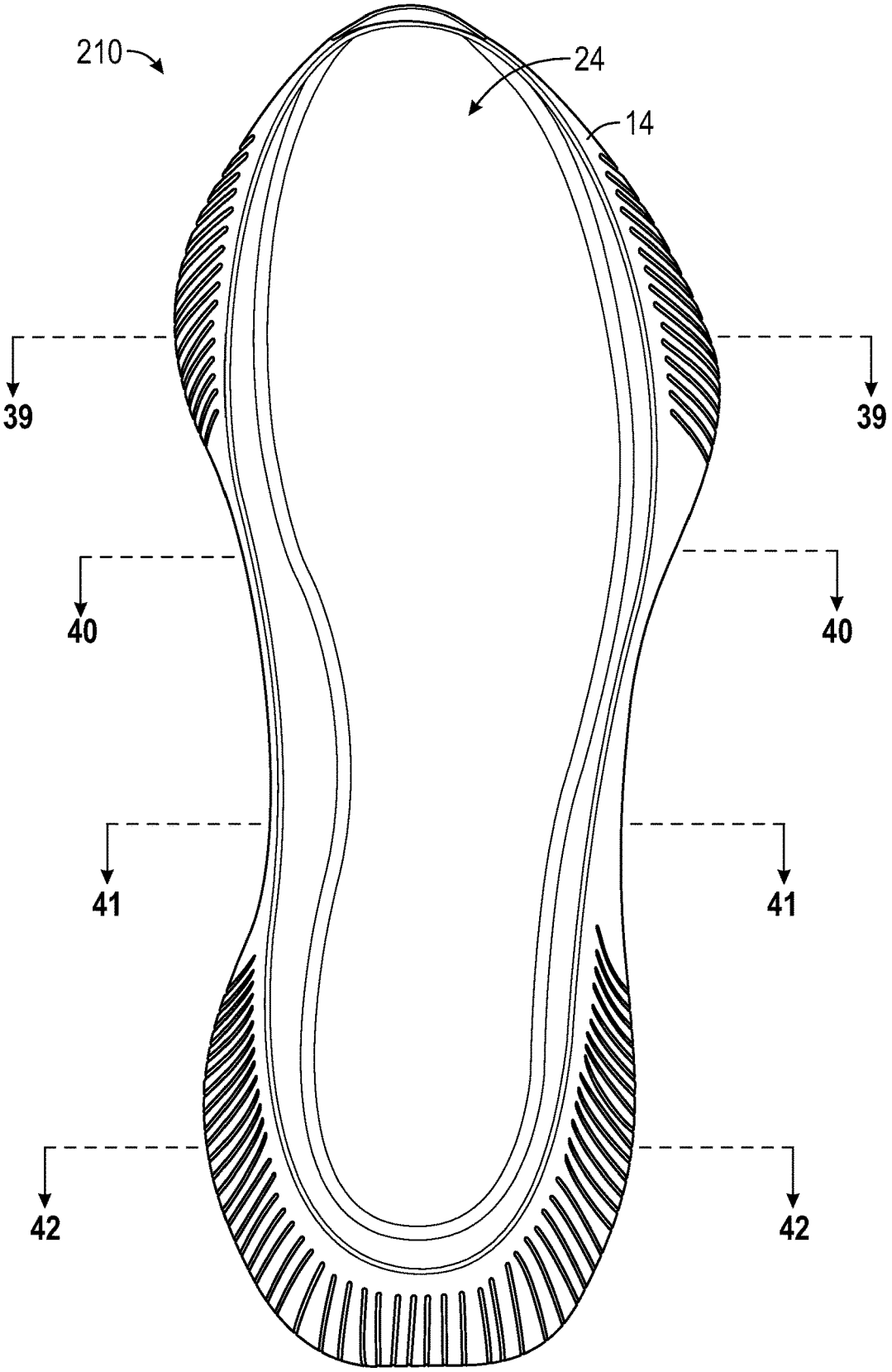
FIG. 36 is a top view of the sole structure of FIG. 32.
Figure 37:
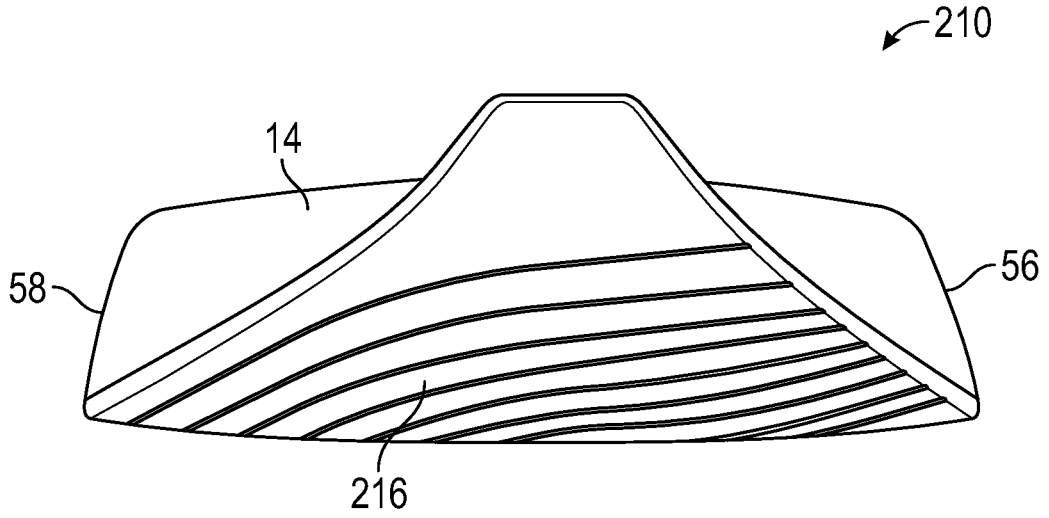
FIG. 37 is a front view of the sole structure of FIG. 32.
Figure 38:
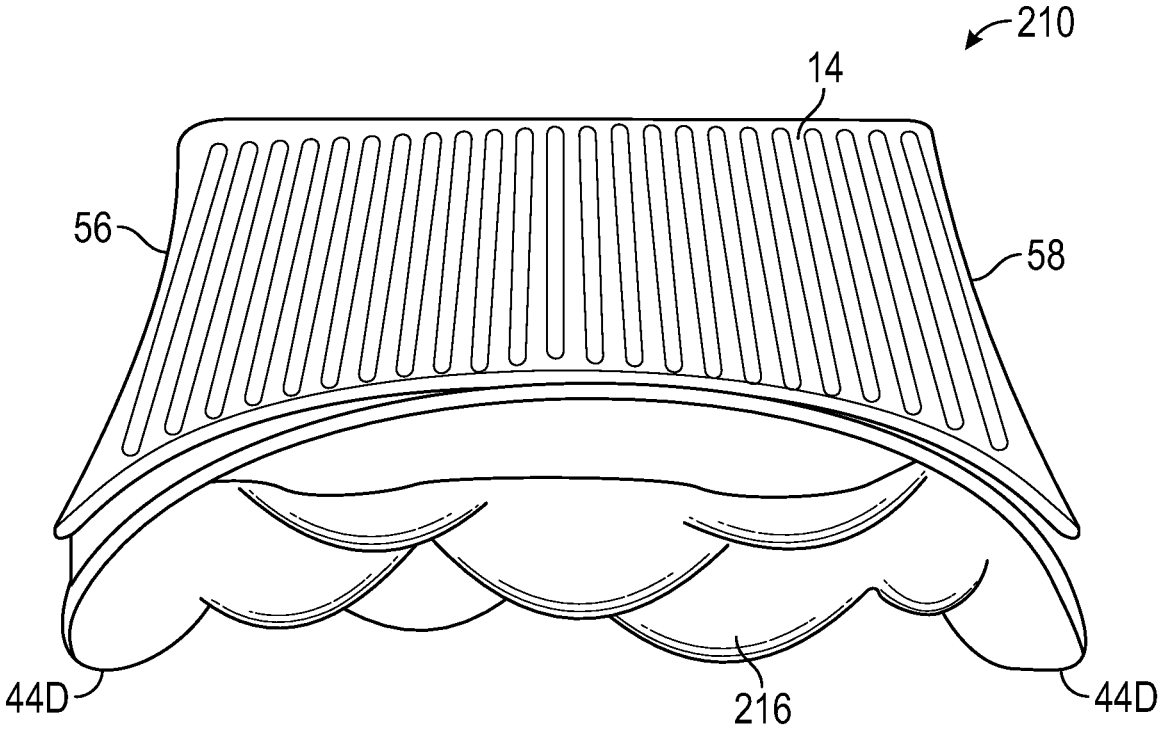
FIG. 38 is a rear view of the sole structure of FIG. 32.
Figure 39:
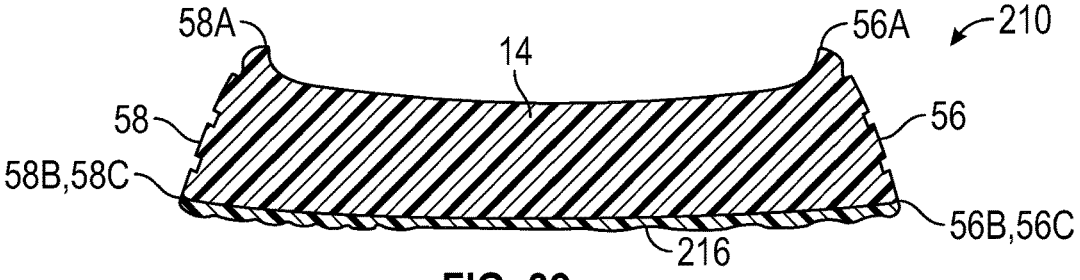
FIG. 39 is a cross-sectional view of the sole structure of FIG. 32 taken at lines 39-39 in FIG. 36.
Figure 40:
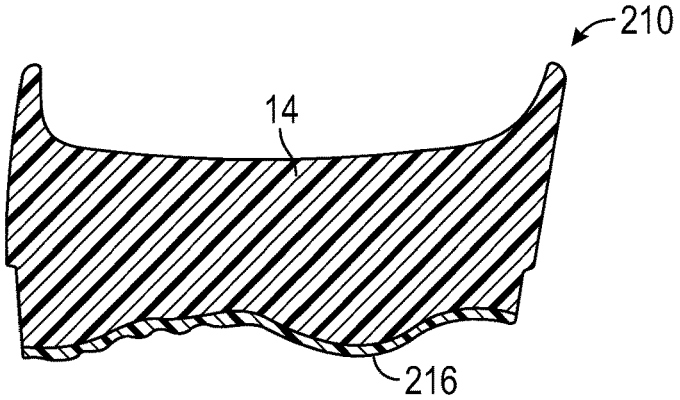
FIG. 40 is a cross-sectional view of the sole structure of FIG. 32 taken at lines 40-40 in FIG. 36.
Figure 41:
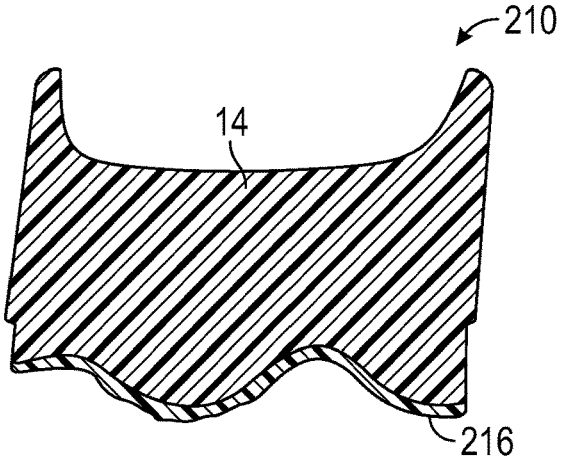
FIG. 41 is a cross-sectional view of the sole structure of FIG. 32 taken at lines 41-41 in FIG. 36.
Figure 42:
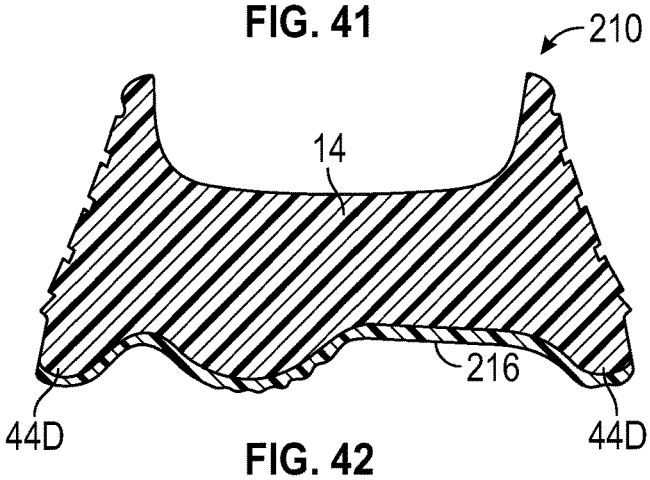
FIG. 42 is a cross-sectional view of the sole structure of FIG. 32 taken at lines 42-42 in FIG. 36.

FIGS. 33 and 34 show the truncated peripheral protrusions 44D. FIGS. 38 and 42 best show the medial-lateral stability afforded by the truncated protrusions 44D in the heel region 26. FIG. 35 best shows the arced profile of the sole structure 210. FIGS. 36-42 show the flaring side walls 56, 58. FIG. 39 also shows the medial side wall 56 and the lateral side wall 58 flaring outward from the upper extent 56A, 58A to the lower extent 56B, 58B, respectively. FIG. 39 shows that the outsole 216 extends to and underlies the medial side edge 56C and the lateral side edge 58C of the midsole 14, terminating at the medial side edge 56C and the lateral side edge 58C without extending onto the medial side wall 56 and the lateral side wall 58.

Figure 43:
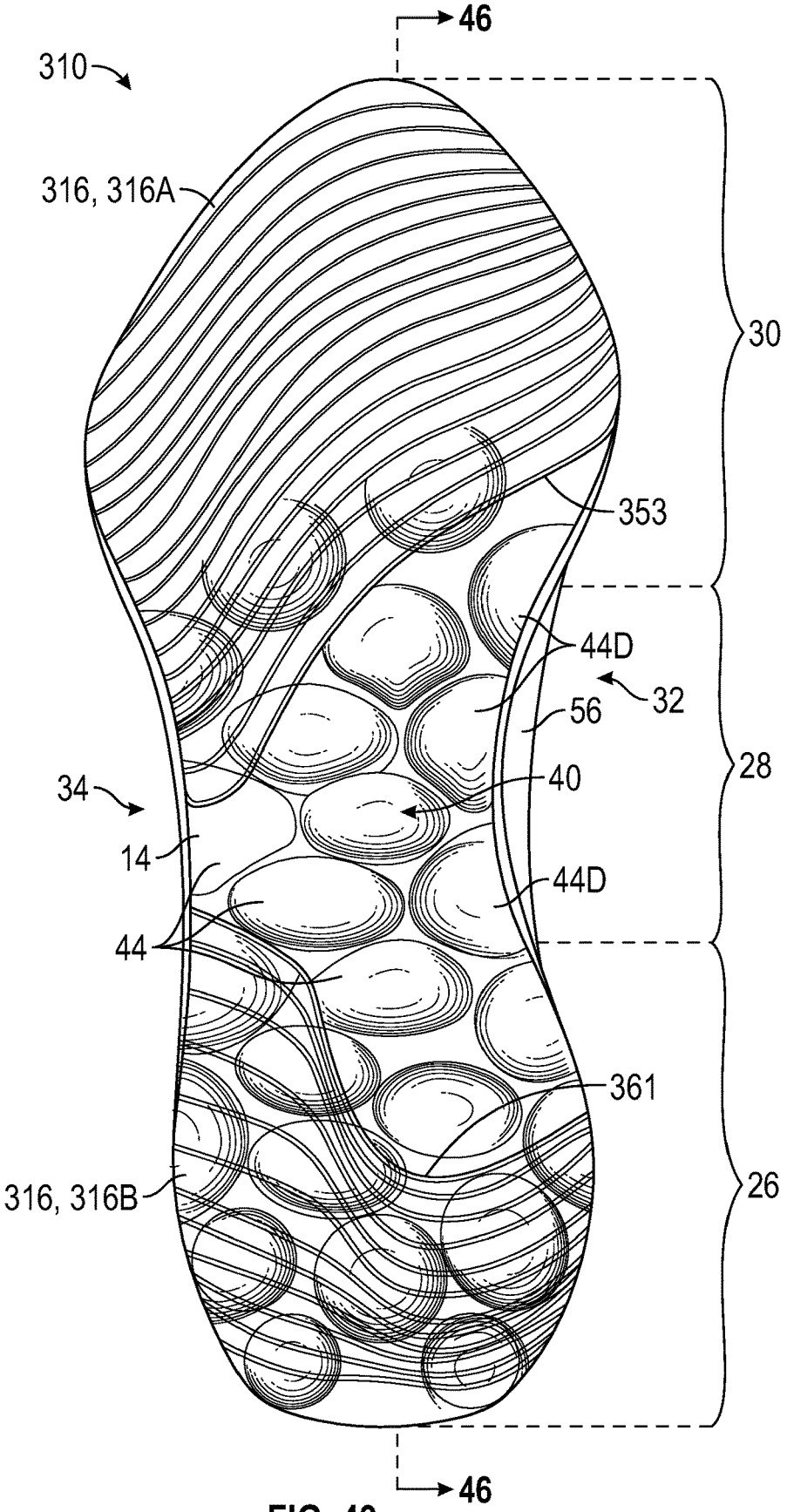
FIG. 43 is a bottom view of another embodiment of a sole structure for an article of footwear including a midsole and an outsole.

FIG. 43 shows another embodiment of a sole structure 310 that may be used in place of the sole structure 10 in the article of footwear 12. The sole structure 310 has the same midsole 14 as described with respect to sole structure 10, but includes a two-piece outsole 316. The outsole 316 includes a forefoot outsole element 316A (also referred to as a first outsole element), and a heel outsole element 316B (also referred to as a second outsole element). The forefoot outsole element 316A covers the majority of the ground-facing surface 40 in the forefoot region 30 and has a non-linear rear edge 353. The heel outsole element 316B covers the majority of the ground-facing surface 40 of the midsole 14 in the heel region 26 and has a nonlinear front edge 361. Many of the downwardly-extending protrusions 44 in the midfoot region 28 (only some of which are labelled) are not covered by any portion of the outsole 316 so that the ground-facing surface 40 in that area also serves as the ground-engaging surface of the sole structure 310.

Figure 44:
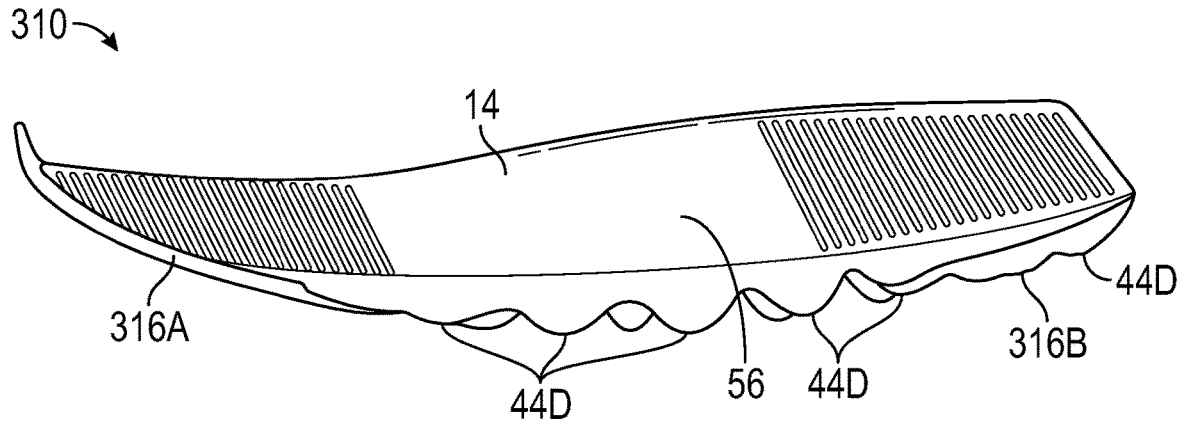
FIG. 44 is a medial side view of the sole structure of FIG. 43.
Figure 45:
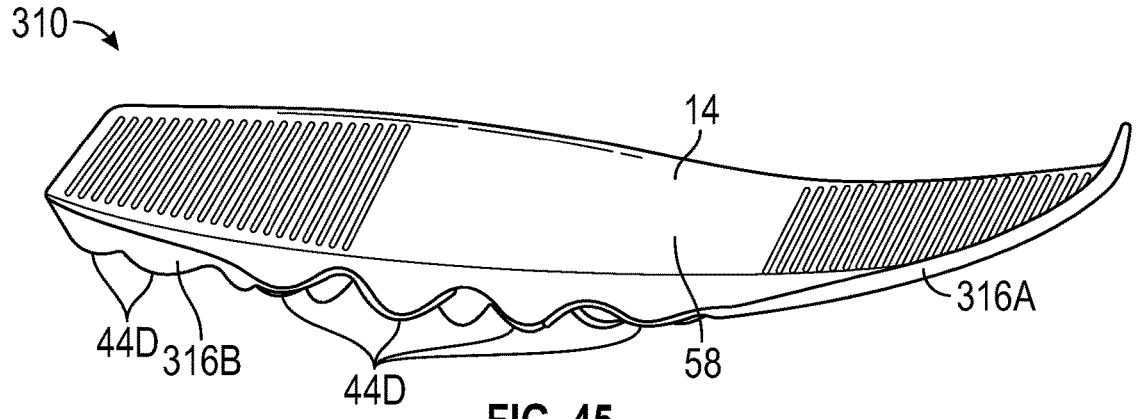
FIG. 45 is a lateral side view of the sole structure of FIG. 43.
Figure 46:
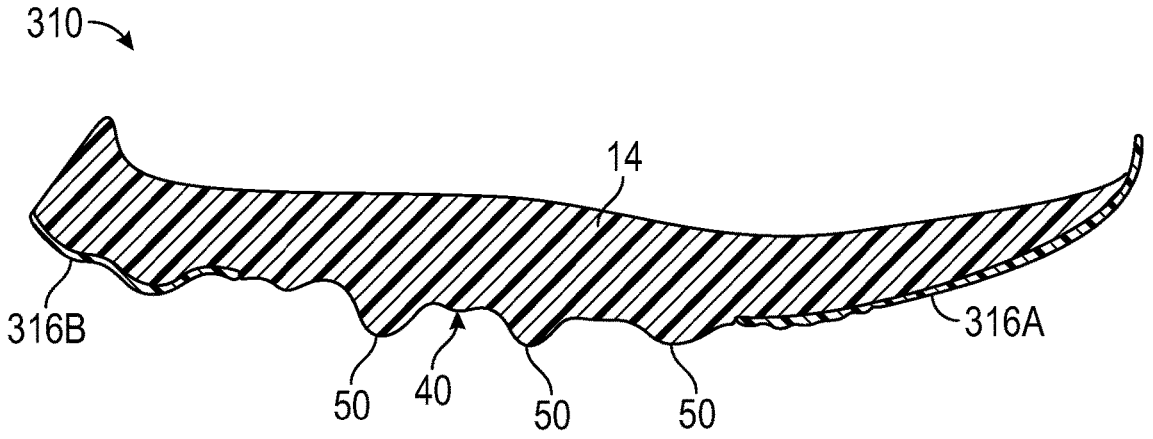
FIG. 46 is a cross-sectional view of the sole structure of FIG. 43 taken at lines 46-46 in FIG. 43.
Figure 47:
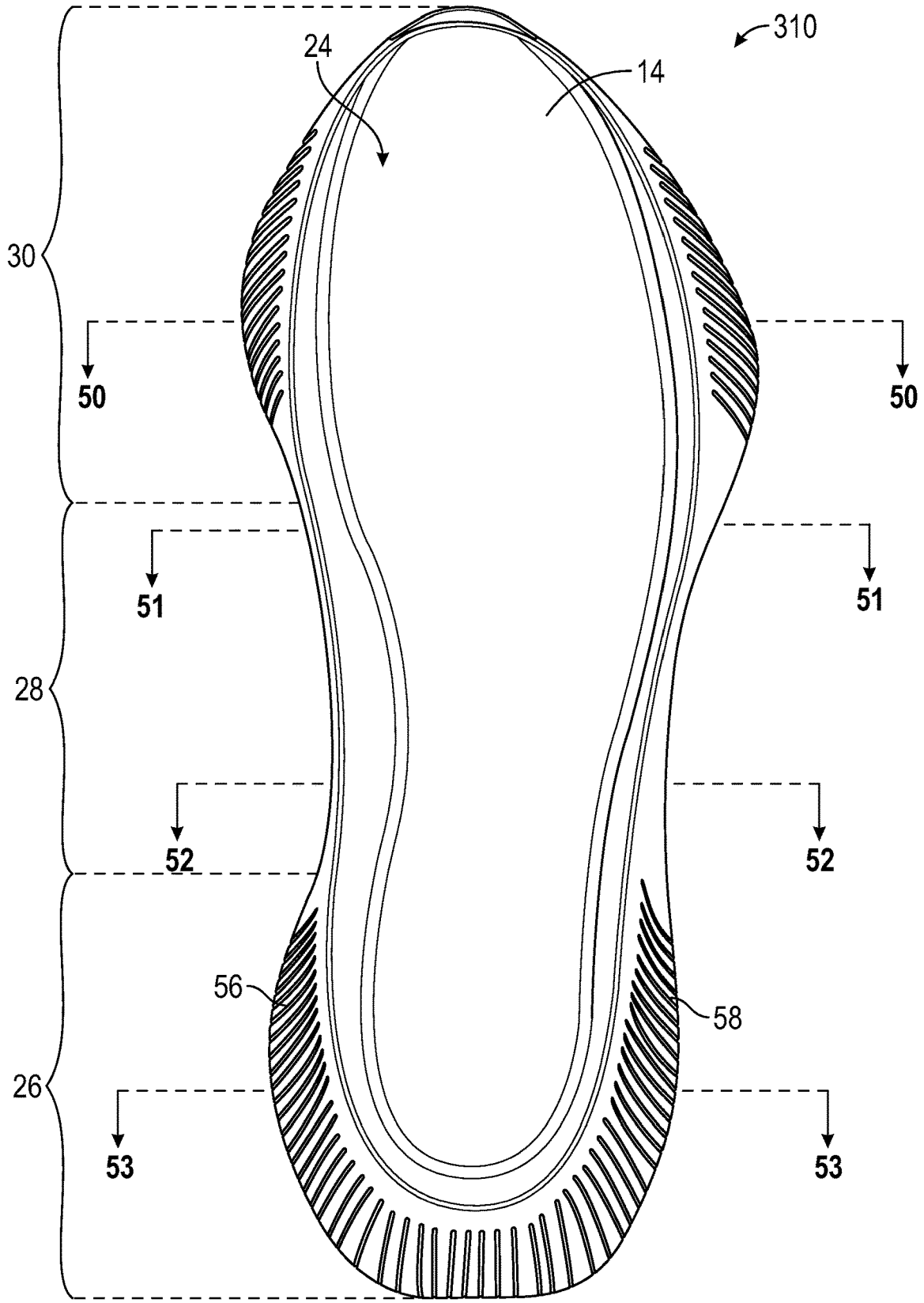
FIG. 47 is a top view of the sole structure of FIG. 43.
Figure 53:
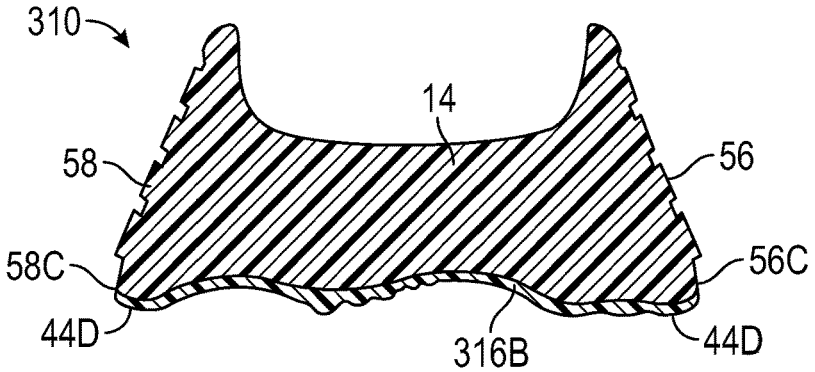
FIG. 53 is a cross-sectional view of the sole structure of FIG. 43 taken at lines 53-53 in FIG. 47.

FIGS. 44 and 45 show the truncated peripheral protrusions 44D. FIGS. 49 and 53 best show the medial-lateral stability afforded by the truncated protrusions 44D in the heel region 26. FIG. 46 best shows the arced profile of the sole structure 310. FIGS. 47-50 show the flaring side walls 56, 58.

Figure 48:
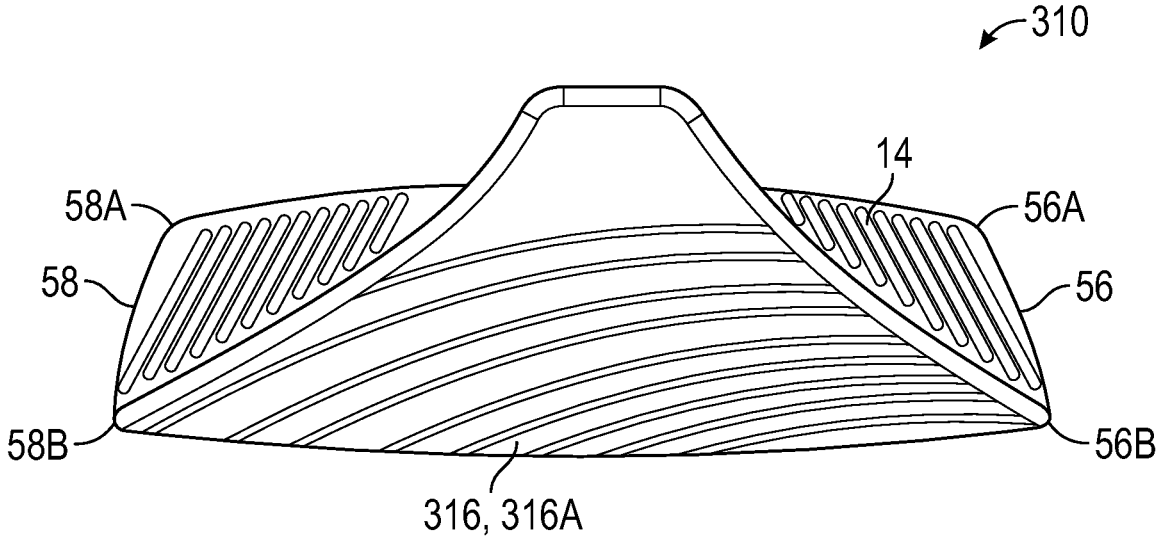
FIG. 48 is a front view of the sole structure of FIG. 43.
Figure 49:
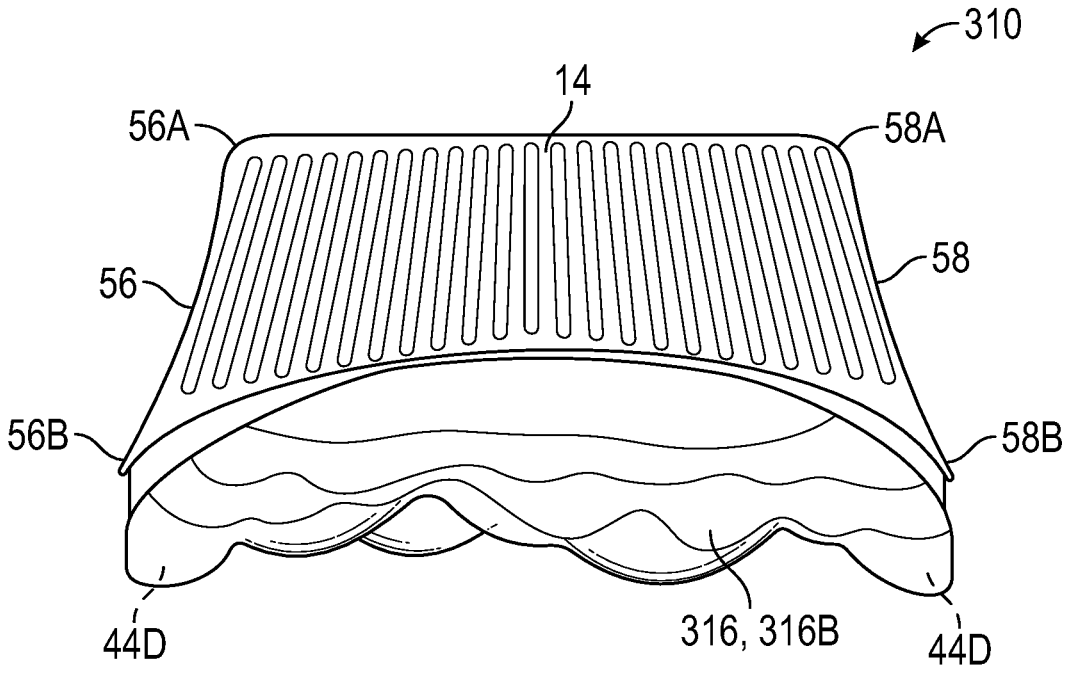
FIG. 49 is a rear view of the sole structure of FIG. 43.
Figure 50:
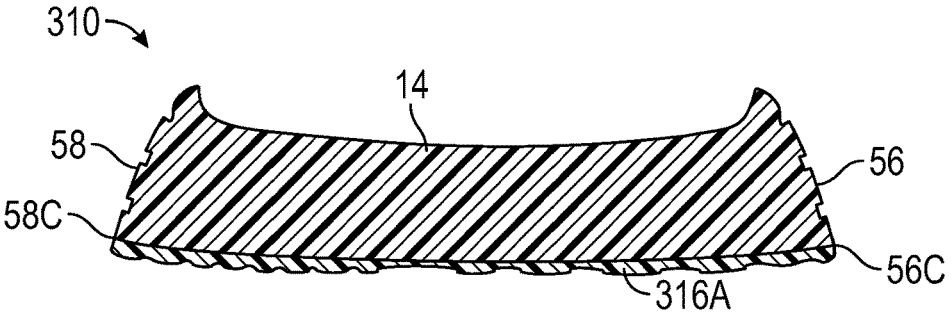
FIG. 50 is a cross-sectional view of the sole structure of FIG. 43 taken at lines 50-50 in FIG. 47.
Figure 51:
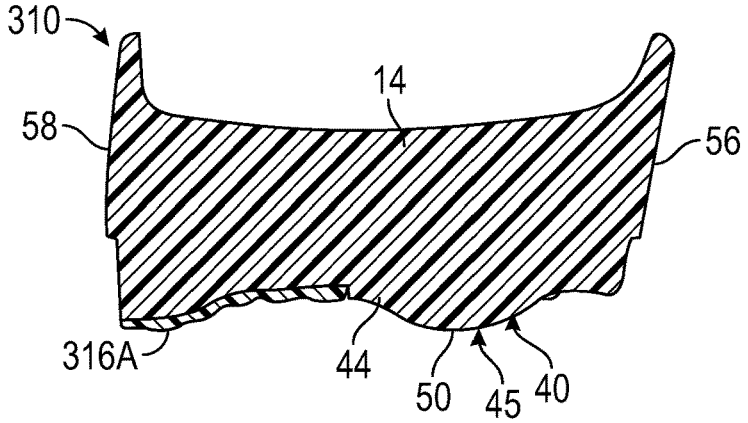
FIG. 51 is a cross-sectional view of the sole structure of FIG. 43 taken at lines 51-51 in FIG. 47.
Figure 52:
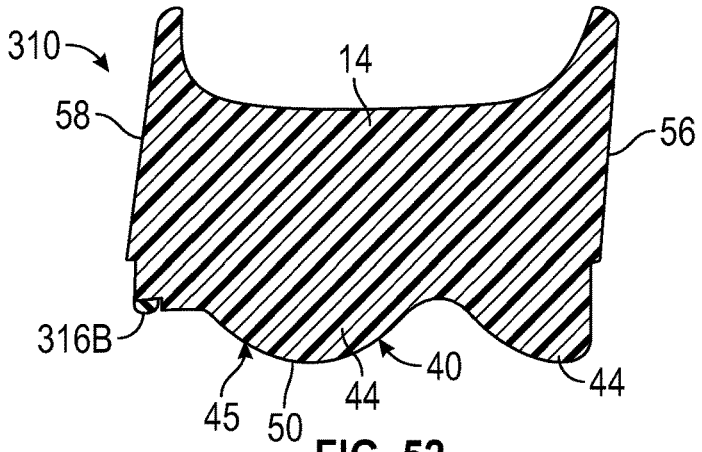
FIG. 52 is a cross-sectional view of the sole structure of FIG. 43 taken at lines 52-52 in FIG. 47.

FIGS. 48-49 show the medial side wall 56 and the lateral side wall 58 flaring outward from the upper extent 56A, 58A to the lower extent 56B, 58B. FIG. 50 shows that the outsole 316 (forefoot outsole element 316A) extends to and underlies the medial side edge 56C and the lateral side edge 58C of the midsole 14, terminating at the medial side edge 56C and the lateral side edge 58C without extending onto the medial side wall 56 and the lateral side wall 58. As shown in FIG. 53, the heel outsole element 316B extends to and underlies the medial side edge 56C and the lateral side edge 58C of the midsole 14, terminating at the medial side edge 56C and the lateral side edge 58C without extending onto the medial side wall 56 and the lateral side wall 58. FIGS. 51 and 52 illustrate that in some portions of the midfoot region 28, the ground-facing surface 40 of the midsole 14 is not covered by the outsole 16 and thus also serves as the ground-contact surface.

The following Clauses provide example configurations of an article of footwear disclosed herein.

Clause 1. A sole structure for an article of footwear, the sole structure comprising: a midsole having a ground-facing surface with a forefoot region, a midfoot region, and a heel region, the midsole defining downwardly-extending protrusions at the ground-facing surface distributed over the midfoot region and the heel region, each of the downwardly-extending protrusions having a convex outer surface; and wherein a height of the midsole is greatest at the midfoot region.

Clause 2. The sole structure of clause 1, wherein the ground-facing surface of the midsole curves upwardly from the midfoot region to a forward extent of the midsole and from the midfoot region to a rear extent of the midsole, establishing an arced profile of the midsole.

Clause 3. The sole structure of clause 1, wherein the ground-facing surface of the forefoot region is relatively flat.

Clause 4. The sole structure of clause 1, wherein the midsole is characterized by an absence of downwardly-extending protrusions in the forefoot region.

Clause 5. The sole structure of any of clauses 1-4, wherein the midsole includes a rear side wall that flares outward from an upper extent to a lower extent of the rear side wall at a rear of the heel region.

Clause 6. The sole structure of any of clauses 1-5, wherein the midsole includes a lateral side wall and a medial side wall each of which has an upper extent and a lower extent and each of which flares outward from the upper extent to the lower extent in the forefoot region.

Clause 7. The sole structure of any of clauses 1-6, wherein the downwardly-extending protrusions include forwardmost protrusions each having a front half and a rear half, and with the convex outer surface steeper at the rear half than at the front half.

Clause 8. The sole structure of any of clauses 1-7, wherein: the downwardly-extending protrusions include peripheral protrusions in the midfoot region that define a lateral side edge and a medial side edge of the ground-facing surface; and the peripheral protrusions are truncated at the lateral side edge and at the medial side edge such that peaks of the peripheral protrusions lie along the lateral side edge and the medial side edge.

Clause 9. The sole structure of any of clauses 1-8, wherein the midsole is a one-piece foam body.

Clause 10. The sole structure of any of clauses 1-9, further comprising: an outsole including an outsole element covering the ground-facing surface of the midsole in the forefoot region.

Clause 11. The sole structure of clause 10, wherein the outsole element is a first outsole element, and the outsole further includes a second outsole element covering the ground-facing surface of the midsole in the heel region.

Clause 12. The sole structure of clause 11, wherein: the outsole further includes a third outsole element covering the ground-facing surface of the midsole in the midfoot region; the first outsole element and the third outsole element are separated by a first gap extending from a medial edge to a lateral edge of the midsole; the midsole includes a first ridge that extends into and at least partially fills the first gap; the second outsole element and the third outsole element separated by a second gap extending from a medial edge to a lateral edge of the midsole; and the midsole includes a second ridge that extends into and at least partially fills the second gap.

Clause 13. The sole structure of clause 12, wherein the first ridge and the second ridge are nonlinear.

Clause 14. The sole structure of any of clauses 1-9, further comprising: an outsole covering at least a portion of the ground-facing surface of the midsole; and wherein a height of the sole structure is greatest at the midfoot region.

Clause 15. The sole structure of clause 14, wherein the outsole is thicker at peaks of the downwardly-extending protrusions than at the ground-facing surface of the midsole between adjacent peaks of the downwardly-extending protrusions.

Clause 16. The sole structure of clause 14 or 15, wherein: the midsole includes a medial side wall having a lower medial side edge and a lateral side wall having a lower lateral side edge; and the outsole extends to and underlies the medial side edge and the lateral side edge, terminating at the medial side edge and the lateral side edge without extending onto the medial side wall and the lateral side wall.

Clause 17. The sole structure of any of clauses 14-16, wherein: the outsole includes a forefoot outsole element, a midfoot outsole element, and a heel outsole element, each of the forefoot outsole element, the midfoot outsole element, and the heel outsole element extending from a medial side wall to a lateral side wall of the midsole; a rear edge of the forefoot outsole element is spaced apart from a forward edge of the midfoot outsole element defining a first gap between the rear edge of the forefoot outsole element and the forward edge of the midfoot outsole element; and a rear edge of the midfoot outsole element is spaced apart from a forward edge of the heel outsole element defining a second gap between the rear edge of the midfoot outsole element and the forward edge of the heel outsole element.

Clause 18. The sole structure of clause 17, wherein the rear edge of the forefoot outsole element has an irregular shape, and the forward edge of the midfoot outsole element has a complementary irregular shape that tracks the irregular shape of the rear edge of the forefoot outsole element.

Clause 19. The sole structure of clause 17 or 18, wherein the forward edge of the heel outsole element has an irregular shape, and the rear edge of the midfoot outsole element has a complementary irregular shape that tracks the irregular shape of the forward edge of the heel outsole element.

Clause 20. The sole structure of clause 19, wherein the midsole includes a first ridge that extends into and at least partially fills the first gap, and the midsole includes a second ridge that extends into and at least partially fills the second gap.

Clause 21. A sole structure for an article of footwear, the sole structure comprising: a midsole having a ground-facing surface with a forefoot region, a midfoot region, and a heel region, the midsole defining downwardly-extending protrusions at the ground-facing surface distributed over the midfoot region and the heel region and absent from at least a forward half of the forefoot region, each of the downwardly-extending protrusions having a convex outer surface, the downwardly-extending protrusions including: midfoot protrusions in the midfoot region having widths in a transverse direction of the midsole greater than lengths in a longitudinal direction of the midsole, and heel protrusions in the heel region having width-to-length ratios less than width-to-length ratios of the midfoot protrusions.

Clause 22. The sole structure of clause 21, wherein a height of the midsole is greater at the midfoot protrusions than at the heel protrusions, and greater at the midfoot protrusions than at the forefoot region.

Clause 23. The sole structure of clause 22, wherein the ground-facing surface of the midsole curves upwardly from the midfoot region to a forward extent of the midsole and from the midfoot region to a rear extent of the midsole, establishing an arced profile of the midsole.

Clause 24. The sole structure of any of clauses 21-23, wherein the midsole includes a rear side wall that flares outward from an upper extent to a lower extent of the rear side wall at a rear of the heel region.

Clause 25. The sole structure of any of clauses 21-23, wherein the midsole includes a lateral side wall and a medial side wall each of which has an upper extent and a lower extent and flares outward from the upper extent to the lower extent in the forefoot region.

Clause 26. The sole structure of any of clauses 21-23, wherein the downwardly-extending protrusions include forwardmost protrusions each having a front half and a rear half, and with the convex outer surface steeper at the rear half than at the front half.

Clause 27. The sole structure of any of clauses 21-23, wherein the midsole is a foam body and the midfoot protrusions are a ground contact surface of the foam body.

Clause 28. The sole structure of any of clauses 12-23, wherein the midsole is a foam body and the heel protrusions are a ground contact surface of the foam body.

Clause 29. The sole structure of any of clauses 21-23, further comprising: an outsole element covering the ground-facing surface of the midsole only in the forefoot region.

Clause 30. The sole structure of clause 29, wherein forwardmost protrusions of the downwardly-extending protrusions are rearward of a widest portion of the midsole in the forefoot region, and a majority of the outsole element is forward of the widest portion of the midsole in the forefoot region.

Clause 31. The sole structure of any of clauses 21-23, wherein spacing between adjacent ones of the heel protrusions is greater than spacing between adjacent ones of the midfoot protrusions.

Clause 32. The sole structure of any of clauses 21-23, wherein: the downwardly-extending protrusions include peripheral protrusions in the midfoot region that define a lateral side edge and a medial side edge of the ground-facing surface; and the peripheral protrusions are truncated at the lateral side edge and at the medial side edge such that peaks of the peripheral protrusions lie along the lateral side edge and the medial side edge.

Clause 33. The sole structure of any of clauses 21-23, wherein the midsole is a one-piece foam body.

Clause 34. A sole structure for an article of footwear, the sole structure comprising: a midsole having a ground-facing surface with a forefoot region, a midfoot region, and a heel region, the midsole defining downwardly-extending protrusions distributed over the midfoot region and the heel region, and the forefoot region being relatively flat; wherein the downwardly-extending protrusions have convex outer surfaces and transitioning in a forward direction from relatively round to relatively oblong and back to relatively round, each of the relatively oblong downwardly-extending protrusions having a width in a transverse direction of the midsole greater than a length in a longitudinal direction of the midsole, and wherein the relatively oblong downwardly-extending protrusions are taller than the relatively round downwardly-extending protrusions, and the midsole arcs upward from the midfoot region to the heel region and upward from the midfoot region to the forefoot region.

Clause 35. The sole structure of clause 34, wherein the downwardly-extending protrusions are a ground contact surface of the midsole.

Clause 36. The sole structure of clause 35, further comprising: an outsole element covering the ground-facing surface of the midsole only in the forefoot region.

Clause 37. The sole structure of any of clauses 34-36, wherein the midsole includes a rear side wall that flares outward from an upper extent to a lower extent of the rear side wall at a rear of the heel region.

Clause 38. The sole structure of any of clauses 34-36, wherein the midsole includes a lateral side wall and a medial side wall each of which has an upper extent and a lower extent and flares outward from the upper extent to the lower extent in the forefoot region.

Clause 39. The sole structure of any of clauses 34-36, wherein the downwardly-extending protrusions include forwardmost protrusions each having a front half and a rear half, and with the convex outer surface steeper at the rear half than at the front half.

Clause 40. The sole structure of any of clauses 34-36, wherein: the downwardly-extending protrusions include peripheral protrusions in the midfoot region that define a lateral side edge and a medial side edge of the ground-facing surface; and the peripheral protrusions are truncated at the lateral side edge and at the medial side edge such that peaks of the peripheral protrusions lie along the lateral side edge and the medial side edge.

To assist and clarify the description of various embodiments, various terms are defined herein. Unless otherwise indicated, the following definitions apply throughout this specification (including the claims). Additionally, all references referred to are incorporated herein in their entirety.

An "article of footwear", a "footwear article of manufacture", and "footwear" may be considered to be both a machine and a manufacture. Assembled, ready to wear footwear articles (e.g., shoes, sandals, boots, etc.), as well as discrete components of footwear articles (such as a midsole, an outsole, an upper component, etc.) prior to final assembly into ready to wear footwear articles, are considered and alternatively referred to herein in either the singular or plural as "article(s) of footwear".

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives may be employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims.

The term "longitudinal" refers to a direction extending along a length of a component. For example, a longitudinal direction of a shoe extends between a forefoot region and a heel region of the shoe. The term "forward" or "anterior" is used to refer to the general direction from a heel region toward a forefoot region, and the term "rearward" or "posterior" is used to refer to the opposite direction, i.e., the direction from the forefoot region toward the heel region. In some cases, a component may be identified with a longitudinal axis as well as a forward and rearward longitudinal direction along that axis. The longitudinal direction or axis may also be referred to as an anterior-posterior direction or axis.

The term "transverse" refers to a direction extending along a width of a component. For example, a transverse direction of a shoe extends between a lateral side and a medial side of the shoe. The transverse direction or axis may also be referred to as a lateral direction or axis or a mediolateral direction or axis.

The term "vertical" refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" or "upwards" refers to the vertical direction pointing towards a top of the component, which may include an instep, a fastening region and/or a throat of an upper. The term "downward" or "downwards" refers to the vertical direction pointing opposite the upwards direction, toward the bottom of a component and may generally point towards the bottom of a sole structure of an article of footwear.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

What is claimed is:

1. A sole structure for an article of footwear, the sole structure comprising: a midsole having a ground-facing surface with a forefoot region, a midfoot region, and a heel region, the midsole defining downwardly-extending protrusions at the ground-facing surface distributed over the midfoot region and the heel region, each of the downwardly-extending protrusions having a convex outer surface; and an outsole covering at least a portion of the ground-facing surface of the midsole; wherein: a height of the sole structure is greatest at the midfoot region; a height of the midsole from a foot-facing surface of the midsole on which a foot rests to the ground-facing surface of the midsole is greatest at the midfoot region such that a height of the midsole in the heel region from the foot-facing surface to the ground-facing surface is less than the height of the midsole in the midfoot region; the outsole includes a forefoot outsole portion, a midfoot outsole portion, and a heel outsole portion, each of the forefoot outsole portion, the midfoot outsole portion, and the heel outsole portion extending from a medial side wall to a lateral side wall of the midsole; a rear edge of the forefoot outsole portion is spaced apart from a forward edge of the midfoot outsole portion defining a first gap between the rear edge of the forefoot outsole portion and the forward edge of the midfoot outsole portion; a rear edge of the midfoot outsole portion is spaced apart from a forward edge of the heel outsole portion defining a second gap between the rear edge of the midfoot outsole portion and the forward edge of the heel outsole portion; wherein the outsole is thicker at peaks of the downwardly-extending protrusions than at the ground-facing surface of the midsole between adjacent peaks of the downwardly-extending protrusions; and wherein the rear edge of the forefoot outsole portion has an irregular shape that is nonlinear from a medial extent of the rear edge of the forefoot outsole portion to a lateral extent of the rear edge of the forefoot outsole portion and is furthest forward between the medial extent of the forefoot outsole portion and the lateral extent of the forefoot outsole portion, and the forward edge of the midfoot outsole portion has a complementary irregular shape that tracks the irregular shape of the rear edge of the forefoot outsole portion such that a width of the first gap is substantially constant.

2. The sole structure of claim 1, wherein the forward edge of the heel outsole portion has an irregular shape, and the rear edge of the midfoot outsole portion has a complementary irregular shape that tracks the irregular shape of the forward edge of the heel outsole portion.

3. The sole structure of claim 1, wherein the ground-facing surface of the midsole in the heel region has a nonlinear profile from a forward extent of the heel region to a rear extent of the midsole that curves upwardly continuously from the forward extent of the heel region to the rear extent of the midsole.

4. The sole structure of claim 3, wherein the ground-facing surface of the midsole curves upwardly from the midfoot region to a forward extent of the midsole establishing an arced profile of the midsole.

5. The sole structure of claim 3, wherein the forefoot region extends from the midfoot region to a forward extent of the midsole, and the midsole is characterized by an absence of downwardly-extending protrusions in a forward half of the forefoot region.

6. The sole structure of claim 3, wherein the midsole includes a rear side wall that flares outward from an upper extent to a lower extent of the rear side wall at a rear of the heel region.

7. The sole structure of claim 3, wherein the midsole includes a lateral side wall and a medial side wall each of which has an upper extent and a lower extent and each of which flares outward from the upper extent to the lower extent in the forefoot region.

8. The sole structure of claim 3, wherein the downwardly-extending protrusions include forwardmost protrusions each having a front half and a rear half, and with the convex outer surface steeper at the rear half than at the front half.

9. The sole structure of claim 8, wherein the front half extends rearward to a peak and the rear half extends rearward from the peak.

10. The sole structure of claim 3, wherein: the downwardly-extending protrusions include peripheral protrusions in the midfoot region that define a lateral side edge and a medial side edge of the ground-facing surface; and the peripheral protrusions are truncated at the lateral side edge and at the medial side edge such that peaks of the peripheral protrusions lie along the lateral side edge and the medial side edge and the peripheral protrusions slope upward and inward from the peaks at the medial side edge and the lateral side edge.

11. The sole structure of claim 3, wherein the midsole is a one-piece foam body.

12. The sole structure of claim 3, wherein: the midsole includes a medial side wall having a lower medial side edge and a lateral side wall having a lower lateral side edge; and the outsole extends to and underlies the lower medial side edge and the lower lateral side edge, terminating at the lower medial side edge and the lower lateral side edge without extending onto the medial side wall and the lateral side wall.

13. The sole structure of claim 3, wherein the ground-facing surface of the midsole curves continuously from a posterior extent of the heel region to an anterior extent of the forefoot region.

* * * * *